US012065922B2

(12) United States Patent
Hohl

(10) Patent No.: US 12,065,922 B2
(45) Date of Patent: Aug. 20, 2024

(54) ESTIMATION OF MAXIMUM LOAD AMPLITUDES IN DRILLING SYSTEMS USING MULTIPLE INDEPENDENT MEASUREMENTS

(71) Applicant: Baker Hughes Oilfield Operations LLC, Houston, TX (US)

(72) Inventor: Andreas Hohl, Hannover (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/085,773

(22) Filed: Dec. 21, 2022

(65) Prior Publication Data

US 2023/0193740 A1 Jun. 22, 2023

Related U.S. Application Data

(60) Provisional application No. 63/292,751, filed on Dec. 22, 2021.

(51) Int. Cl.
*E21B 44/00* (2006.01)

(52) U.S. Cl.
CPC ..... *E21B 44/00* (2013.01)

(58) Field of Classification Search
CPC ..... E21B 44/00
See application file for complete search history.

(56) References Cited

U.S. PATENT DOCUMENTS

| | | | | |
|---|---|---|---|---|
| 9,004,195 | B2 | 4/2015 | Regener et al. | |
| 2005/0047275 | A1 | 3/2005 | Chamberlain et al. | |
| 2013/0248247 | A1 | 9/2013 | Sugiura | |
| 2014/0362664 | A1* | 12/2014 | Stolpman | G01V 1/48 367/25 |
| 2015/0160101 | A1* | 6/2015 | Gao | G01M 13/028 702/6 |
| 2015/0233792 | A1* | 8/2015 | Gao | G01M 99/005 702/35 |
| 2019/0278240 | A1 | 9/2019 | Anno et al. | |

(Continued)

OTHER PUBLICATIONS

International Searc Report for International Application No. PCT/US2022053747; Date of Search: May 9, 2023; 3 pages.

(Continued)

*Primary Examiner* — Shane Bomar
(74) *Attorney, Agent, or Firm* — CANTOR COLBURN LLP

(57) ABSTRACT

Methods and systems for mitigating vibration in drill strings include performing a drilling operation using a disintegrating tool, obtaining a first load measurement of a first load during the drilling operation using a first load sensor having a first sampling rate in the drill string, obtaining a second load measurement of a second load during the drilling operation using a second load sensor having a second sampling rate in the drill string, wherein the second load measurement is different from the first load measurement, and wherein the first load measurement and the second load measurement are synchronized with an accuracy that is greater than a first sampling interval corresponding to the first sampling rate and a second sampling interval corresponding to the second sampling rate, and performing a vibration mitigation operation

20 Claims, 11 Drawing Sheets

(56) References Cited

U.S. PATENT DOCUMENTS

| | | | | |
|---|---|---|---|---|
| 2019/0360320 | A1* | 11/2019 | Hohl | E21B 21/08 |
| 2020/0191985 | A1* | 6/2020 | Kristiansen | G01V 1/303 |
| 2021/0062644 | A1 | 3/2021 | MacPherson | |
| 2021/0301642 | A1* | 9/2021 | Wicks | E21B 44/00 |
| 2022/0276143 | A1* | 9/2022 | Magana Mora | G06F 18/217 |

OTHER PUBLICATIONS

Written Opinion for International Application No. PCT/US2022053747; Date of Search: May 9, 2023; 5 pages.

* cited by examiner

ESTIMATION OF MAXIMUM LOAD AMPLITUDES IN DRILLING SYSTEMS USING MULTIPLE INDEPENDENT MEASUREMENTS

CROSS REFERENCE TO RELATED APPLICATIONS

This application claims the benefit of an earlier filing date from U.S. Provisional Application Ser. No. 63/292,751, filed Dec. 22, 2021, the entire disclosure of which is incorporated herein by reference.

BACKGROUND

1. Field of the Invention

The present invention generally relates to subsurface operations and more particularly to estimation of maximum load amplitudes during drilling operations that is based on multiple, independent sensors/measurements.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to energy or a material (e.g., heat, a gas, or fluid) contained in a formation located below the earth's surface. Different types of tools and instruments may be disposed in the boreholes to perform various tasks and measurements.

During drilling operations, severe vibrations in drill strings and bottomhole assemblies can be caused by cutting forces at the bit or mass imbalances in downhole tools such as mud motors. Such vibrations can result in reduced rates of penetration, reduced quality of measurements, and, potentially, downhole failures. As such, it is important to determine and operate using drilling parameters (e.g., string RPM, bit RPM, WOB, etc.) that reduce and/or mitigate vibrations.

During drilling operations, adjustment of the drilling parameters may be based on objective criteria that represents the downhole vibration level. The objective criteria are needed at the surface to help a driller (e.g., operator) to adjust the drilling parameters. Measurements from accelerometers or other downhole sensors are typically used for this purpose. However, the interpretation of this data is limited due to several reasons. For example, the various downhole measurements are dependent on the position of the sensor(s) located downhole. Further, when using accelerometers, torsional/tangential accelerations and radial accelerations are proportional to the radius, and thus an interpretation of data therefrom can lead only to reasonable results if the field personnel are aware of the interdependencies and the sensor position. Moreover, distance-from-bit of the sensor can impact obtained information. For example, the amplitudes associated to different vibration mode or modes that are excited may be based on the distance-from-bit of the sensor position which in turn influences the measurement. That is, the measurements are strongly dependent on the vibration mode shape or mode shapes that are excited. For example, in a node of a vibration mode shape no amplitude is measured (not observable) and vice versa. Moreover, filter characteristics and sampling rates can limit the frequencies that contribute to the overall observable vibration amplitude level. Additionally, as will be appreciated by those of skill in the art, the sensor positions are not perfectly aligned and/or the position tolerances of the sensors may be too high. Therefore, the separation of lateral, radial, and torsional/tangential acceleration (vibration) may not be accurate. Accordingly, improved means for determining and/or estimating downhole vibrations may be advantageous.

SUMMARY

Disclosed herein are systems and methods for mitigating vibration in drill strings. The methods for mitigating vibration in a drill string include performing a drilling operation using a disintegrating tool, obtaining a first load measurement of a first load during the drilling operation using a first load sensor having a first sampling rate in the drill string, obtaining a second load measurement of a second load during the drilling operation using a second load sensor having a second sampling rate in the drill string, wherein the second load measurement is different from the first load measurement, and wherein the first load measurement and the second load measurement are synchronized with an accuracy that is greater than a first sampling interval corresponding to the first sampling rate and a second sampling interval corresponding to the second sampling rate, and performing a vibration mitigation operation in response to the first measurement and the second measurement.

Systems for mitigating vibration of a drill string include a drilling tool on the drill string and arranged to perform a drilling operation, a first load sensor arranged on the drill string and configured to obtain a first load measurement of a first load during the drilling operation, wherein the first load sensor has a first sampling rate, a second load sensor arranged on the drill string and configured to obtain a second load measurement of a second load during the drilling operation, wherein the second load sensor has a second sampling rate, wherein the second load measurement is different from the first load measurement, and wherein the first load measurement and the second load measurement are synchronized with an accuracy that is greater than a first sampling interval corresponding to the first sampling rate and a second sampling interval corresponding to the second sampling rate, and a processor operably connected to the first, second, and third load sensors and configured to perform a vibration mitigation operation in response to the first measurement and the second measurement.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
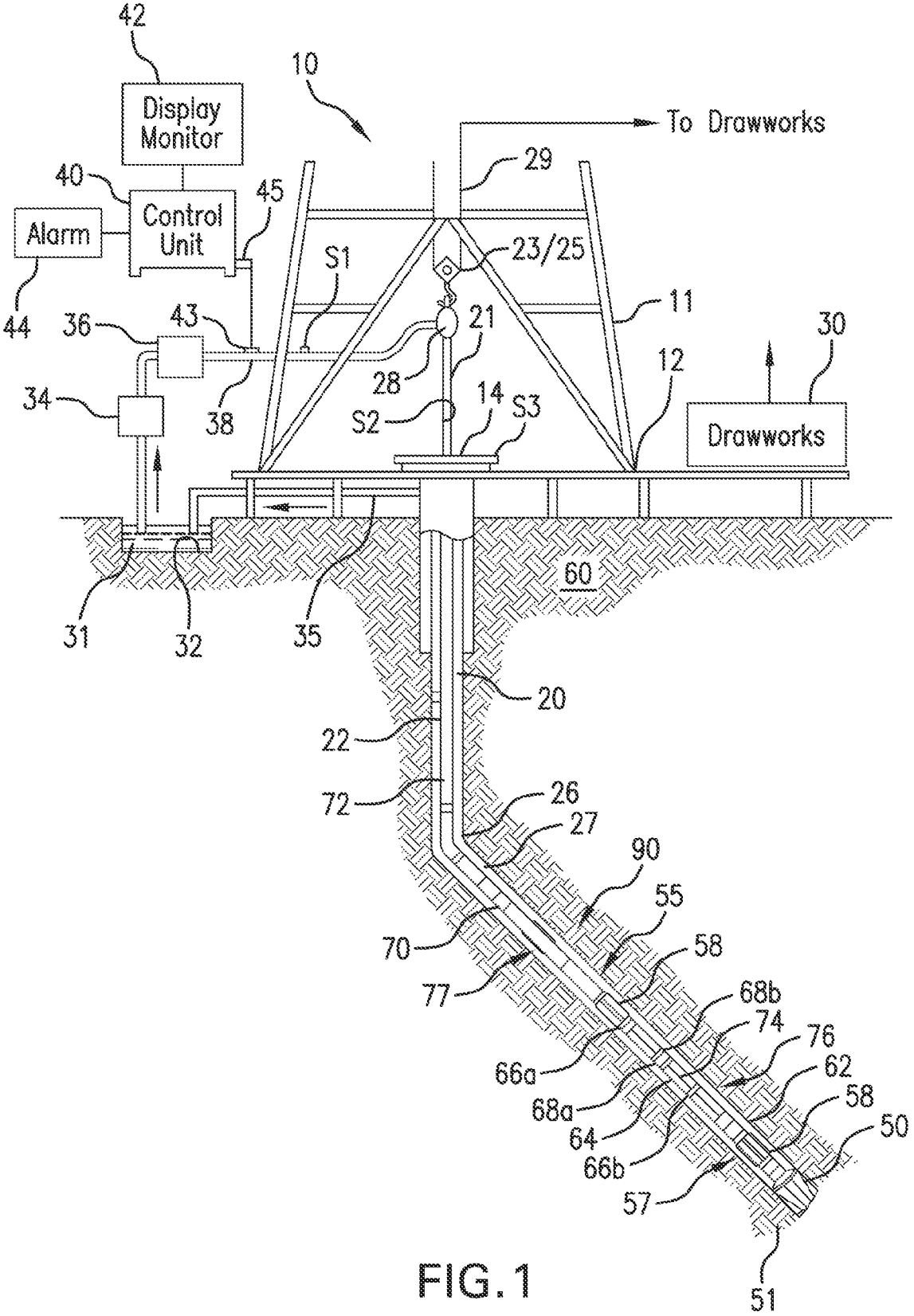
FIG. 1 is an example of a system for performing subsurface operations that can employ embodiments of the present disclosure.

FIG. 1 shows a schematic diagram of a system for performing subsurface operations (e.g., downhole, within the earth or below the earth's surface and into a formation). As shown, the system is a drilling system 10 that includes a drill string 20 having a drilling assembly 90, also referred to as a bottomhole assembly (BHA), conveyed in a wellbore or borehole 26 penetrating an earth formation 60. The drilling system 10 includes a derrick 11, for example a conventional derrick, erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the drilling assembly 90 or a reaming tool (not shown), also known as a reamer, disintegrates the geological formations when it is rotated to drill the borehole 26. The drill string 20 is coupled to a drawworks 30 via a kelly joint 21, swivel 28, traveling block 25, and line 29 through a pulley 23. During the drilling operations, the drawworks 30 is operated to control the weight-on-bit (WOB), which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into an inner bore (e.g., inner bore 260 in FIG. 2A) of the drill string 20 via a desurger 36, fluid line 38 and the kelly joint 21. Fluid line 38 may also be referred to as a mud supply line. The drilling fluid 31 is discharged at the borehole bottom 51 through an opening (not shown) in the disintegrating tool 50. The drilling fluid 31 circulates uphole through the annular space 27 between the drill string 20 and the borehole 26 and returns to the mud pit 32 via a return line 35. A sensor S1 in the fluid line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and other desired parameters relating to the drilling of the borehole 26. The system may further include one or more downhole sensors 70 located on the drill string 20 and/or the drilling assembly 90.

In some applications the disintegrating tool 50 is rotated by rotating the drilling tubular 22 about their longitudinal axis (not shown). However, in other applications, a drilling motor 55 (such as a mud motor) disposed in the drilling assembly 90 is used to rotate the disintegrating tool 50 and a portion of drilling assembly 90 about their longitudinal axis and/or to superimpose or supplement the rotation of the drill string 20 (rotary mode). In either case, the rate of penetration (ROP) of the disintegrating tool 50 into the earth formation 60 for a given formation and a drilling assembly largely depends upon the weight-on-bit and the rotational speed of the disintegrating tool 50. In one aspect of the embodiment of FIG. 1, the drilling motor 55 is coupled to the disintegrating tool 50 via a drive shaft (not shown) disposed in a bearing assembly 57. If a mud motor is employed as the drilling motor 55, the mud motor rotates the disintegrating tool 50 when the drilling fluid 31 passes through the drilling motor 55 under pressure. The bearing assembly 57 supports the radial and axial forces of the disintegrating tool 50, the downthrust of the drilling motor and the reactive upward loading from the applied weight-on-bit. Stabilizers 58 that may be coupled to the bearing assembly 57 and/or at other suitable locations on the drill string 20 act as centralizers, for example for the lowermost portion of the drilling motor assembly and other such suitable locations. The drilling motor 55 may include an Adjustable Kick Off sub (AKO). The deployment of an AKO provides the build of inclination of the borehole when drilling in a sliding mode (i.e., no drill string rotation and the disintegrating tool is only driven by the rotating rotor of the drilling motor). Alternatively, a deviated borehole may be drilled by using a deflection device, such as a steering unit or device (not shown), that enables an operator to steer the disintegrating tool (e.g., drill bit 50) in a desired direction. A steering unit comprises one or more force application devices that may be actuated and controlled hydraulically, electrically, or both.

A surface control unit 40 receives signals from the downhole sensors 70 and devices via a sensor 43 placed in the fluid line 38 as well as from sensors S1, S2, S3, hook load sensors, sensors to determine the height of the traveling block (block height sensors), and any other sensors used in the system and processes such signals according to programmed instructions provided to the surface control unit 40. For example, a surface depth tracking system may be used that utilizes the block height measurement to determine a length of the borehole (also referred to as measured depth of the borehole) or the distance along the borehole from a reference point at the surface to a predefined location on the drill string 20, such as the disintegrating tool 50 or any other suitable location on the drill string 20 (also referred to as measured depth of that location, e.g. measured depth of the disintegrating tool 50). Determination of measured depth at a specific time may be accomplished by adding the measured block height to the sum of the lengths of all equipment that is already within the wellbore at the time of the block height measurement, such as, but not limited to drilling tubulars 22, drilling assembly 90, and disintegrating tool 50. Depth correction algorithms may be applied to the measured depth to achieve more accurate depth information. Depth correction algorithms, for example, may account for length variations due to pipe stretch or compression due to temperature, weight-on-bit, wellbore curvature and direction. By monitoring or repeatedly measuring block height, as well as lengths of equipment that is added to the drill string 20 while drilling deeper into the formation over time, pairs of time and depth information are created that allow estimation of the depth of the borehole 26 or any location on the drill string 20 at any given time during a monitoring period. Interpolation schemes may be used when depth information is required at a time between actual measurements. Such devices and techniques for monitoring depth information by a surface depth tracking system are known in the art and therefore are not described in detail herein.

The surface control unit 40 displays desired drilling parameters and other information on a display/monitor 42 for use by an operator at the rig site to control the drilling operations. The surface control unit 40 contains a computer that may comprise memory for storing data, computer programs, models and algorithms accessible to a processor in the computer, a recorder, such as tape unit, memory unit, etc. for recording data and other peripherals. The surface control unit 40 also may include simulation models for use by the computer to process data according to programmed instructions. The control unit responds to user commands entered through a suitable device, such as a keyboard. The surface control unit 40 can output certain information through an output device, such as s display, a printer, an acoustic output, etc., as will be appreciated by those of skill in the art. The surface control unit 40 may be adapted to activate alarms 44 when certain unsafe or undesirable operating conditions occur.

The drilling assembly 90 may also contain other sensors and devices or tools for providing a variety of measurements relating to the earth formation 60 surrounding the borehole 26 and for drilling the borehole 26 along a desired path. Such devices may include a device for measuring formation properties, such as the formation resistivity or the formation gamma ray intensity around the borehole 26, near and/or in front of the disintegrating tool 50 and devices for determining the inclination, azimuth and/or position of the drill string. A logging-while-drilling (LWD) device for measuring formation properties, such as a formation resistivity tool 64 or a gamma ray device 76 for measuring the formation gamma ray intensity, made according an embodiment described herein may be coupled to the drill string 20 including the drilling assembly 90 at any suitable location. For example, coupling can be done above a lower kick-off subassembly 62 for estimating or determining the resistivity of the earth formation 60 around the drill string 20 including the drilling assembly 90. Another location may be near or in front of the disintegrating tool 50, or at other suitable locations. A directional survey tool 74 that may comprise means to determine the direction of the drilling assembly 90 with respect to a reference direction (e.g., magnetic north, vertical up or down direction, etc.), such as by a magnetometer, gravimeter/accelerometer, gyroscope, etc. may be suitably placed for determining the direction of the drilling assembly, such as the inclination, the azimuth, and/or the toolface of the drilling assembly. Any suitable direction survey tool may be utilized. For example, the directional survey tool 74 may utilize a gravimeter (accelerometer), a magnetometer, or a gyroscopic device to determine the drill string direction (e.g., inclination, azimuth, and/or toolface). Such devices are known in the art and therefore are not described in detail herein.

Direction of the drilling assembly may be monitored or repeatedly determined to allow for, in conjunction with depth measurements as described above, the determination of a wellbore trajectory in a three-dimensional space. In the above-described example configuration, the drilling motor 55 transfers power to the disintegrating tool 50 via a shaft (not shown), such as a hollow shaft, that also enables the drilling fluid 31 to pass from the drilling motor 55 to the disintegrating tool 50. In alternative embodiments, one or more of the parts described above may appear in a different order, or may be omitted from the equipment described above.

Still referring to FIG. 1, other LWD devices (generally denoted herein by numeral 77), such as devices for measuring rock properties or fluid properties, such as, but not limited to, porosity, permeability, density, salt saturation, viscosity, permittivity, sound speed, etc. may be placed at suitable locations in the drilling assembly 90 for providing information useful for evaluating the earth formation 60 (i.e., subsurface formation) or fluids along borehole 26. Such devices may include, but are not limited to, acoustic tools, nuclear tools, nuclear magnetic resonance tools, permittivity tools, and formation testing and sampling tools.

The above-noted devices may store data to a memory downhole and/or transmit data to a downhole telemetry system 72, which in turn transmits the received data uphole to the surface control unit 40. The downhole telemetry system 72 may also receive signals and data from the surface control unit 40 and may transmit such received signals and data to the appropriate downhole devices. In one aspect, a mud pulse telemetry system (including a mud pulser) may be used to communicate data between the downhole sensors 70 and devices and the surface equipment during drilling operations. A sensor 43 placed in the fluid line 38 may detect the mud pressure variations, such as mud pulses responsive to the data transmitted by the downhole telemetry system 72. Sensor 43 may generate signals (e.g., electrical signals) in response to the mud pressure variations and may transmit such signals via a conductor 45 or wirelessly to the surface control unit 40. In other aspects, any other suitable telemetry system may be used for one-way or two-way data communication between the surface and the drilling assembly 90, including but not limited to, a wireless telemetry system (such as an acoustic telemetry system, an electro-magnetic telemetry system), a wired pipe system, or any combination thereof. The data communication system may utilize repeaters in the drill string or the wellbore. In a wired pipe system, one or more wired pipes may be made up by joining drill pipe sections, wherein each pipe section includes a data communication link for electrical signals, such as a wire or any other type of conduit for electrical signal, that runs along the pipe. The data connection between the pipe sections may be made by any suitable method, including but not limited to, electrical or optical line connections, including optical, induction, capacitive or resonant coupling methods. A data communication link may also be run along a side of the drill string 20, for example, if coiled tubing is employed.

The drilling system described thus far relates to those drilling systems that utilize a drill pipe to convey the drilling assembly 90 into the borehole 26, wherein the weight-on-bit is controlled from the surface, typically by controlling the operation of the drawworks. However, a large number of the current drilling systems, especially for drilling highly deviated and horizontal wellbores, utilize coiled-tubing for conveying the drilling assembly subsurface. In such application a thruster is sometimes deployed in the drill string to provide the desired force on the disintegrating tool 50. Also, when coiled-tubing is utilized, the tubing is not rotated by a rotary table but instead it is injected into the wellbore by a suitable injector while a downhole motor, such as drilling motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* and receivers 68*a* or 68*b*. Resistivity can be one formation property that is of interest in making drilling decisions. Those of skill in the art will appreciate that other formation property tools can be employed with or in place of the resistivity tool 64.

Liner drilling or casing drilling can be one configuration or operation used for providing a disintegrating tool that becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting a liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

One or more sensors configured to sense vibrations or oscillations (such as amplitudes or frequencies of vibrations/oscillations) over time may be disposed on the drill string or the BHA. In one or more embodiments, one or more of the sensors may be disposed near the drill bit or disintegrating tool so as to sense vibrations or oscillations near or at a point of excitation of the drill string. The drill bit may be considered a point of excitation due to interaction of the drill bit with a formation rock as the formation rock is being drilled. Alternatively, or in addition thereto, one or more sensors may be configured to sense torque. Sensed data from the one or more sensors may be transmitted to a surface receiver or a surface computer processing system for processing. Alternatively, or in addition thereto, sensor data may be processed downhole by downhole electronics, which may also provide an interface with a telemetry system.

The one or more sensors configured to sense vibrations or oscillations over time may be located in a drilling dynamics tool, for example located close to the bit, or at any position in or along the BHA. The drilling dynamic tool may be designed to sample drilling dynamics data at a relatively high sampling rate (e.g., 1000 Hz and faster with a bandwidth of 450 Hz). A high sampling rate is needed to sample the high frequency vibrations of high frequency torsional oscillations (HFTO). Accordingly, the sampling rate should be in the range of the frequencies occurring in HFTOs (typically between 20 Hz and 1000 Hz) or preferably higher, e.g. twice as high. The BHA may comprise more than one drilling dynamics tool allowing for observation and/or monitoring of drilling dynamics data at different locations in or along the BHA. Such drilling dynamics data may include, without limitation, acceleration (lateral, axial, tangential), bending moment (torque), temperature, pressure, variation in earth magnetic field, weight on bit, and revolutions per minute. In some embodiments described herein, the sensors used to sample drilling dynamics may be stand-alone sensors located somewhere on or in the BHA, independent of a drilling dynamics tool.

Although FIG. 1 is shown and described with respect to a drilling operation, those of skill in the art will appreciate that similar configurations, albeit with different components, can be used for performing different subsurface operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired subsurface operation(s).

In current systems, as noted above, during drilling operations, it may be difficult to accurately determine and/or estimate vibrations of downhole elements (e.g., BHA, string, etc.). However, knowing or accurately estimating vibrations may be important to ensure efficient drilling operations and/or to prevent damage to downhole components. As discussed herein, one variable is associated with uncertainty that arises based on sensor position. Some embodiments provided herein are directed to systems and methods for estimating downhole vibrations that are independent of sensor position, thus eliminating the uncertainty based thereon. Such independent measurements may require a synchronization with a certain synchronization accuracy, but such synchronization may not always be available. Synchronization accuracy, as used herein, is the smallest time interval where two synchronized items measure or use the same time. For example, if two items (e.g., clocks, sensors, or processors) measure or use (e.g., use in calculations, storages, assignments) the same time at two different execution times which are separated by a time interval, that time interval would be named the accuracy of the synchronization. Furthermore, an absolute synchronization accuracy requirement (e.g. a synchronization requirement in absolute time units, such as in seconds or similar) may not be sufficient to determine different relative aspects of different sensing. For example, a synchronization accuracy or synchronization accuracy requirement could be given with respect to a sampling rate or sampling interval of one or more measurements (e.g., synchronization accuracy better—i.e., lower—than a sampling interval of one or more sensors or 1/(sampling rate) of one or more sensors, such as, if one or more sensors sample—i.e., execute the measurements—at a predefined rate of 1,000 Hz, corresponding to a predefined sampling interval of 1/(1,000 Hz)=1 milliseconds, the required synchronization accuracy may be higher than that sampling interval, such as 0.01 seconds, or 0.1 seconds). Similarly, a synchronization accuracy could be defined with respect to a duration of a stationary response of the vibration. A stationary response may be defined by the modal amplitude that scales the amplitudes measured at one frequency of the vibration being equal or similar (e.g., within predefined thresholds) over a certain and defined time period. In that case, the vibrational response would be defined stationary with respect to this time period. Further, in some embodiments, this certain and defined time period may be a requirement for the time synchronization accuracy.

For example, if two items (e.g., clocks, sensors, or processors) need to be synchronized or operate synchronously, the accuracy of that synchronization may be equal or better (i.e., lower) than that certain and defined time period during which the vibrational response is considered stationary. The duration of the certain and defined time period may be known from experience, history, lab experiments/testing, field experiments, modeling, or any combination thereof. One example is the time between so-called stick/slip events that may occur while drilling the wellbore. Stick/slip events, as known in the art, are characterized by the drill string switching relatively quickly between a phase with a relatively low rotational speed (also known as "stick phase", e.g., when the rotational speed of the drill string is zero or close to zero) and a phase with relatively high rotational speed (also known as "slip phase"). Stick/slip phases may occur even while the drill string is continuously rotated by the rotary table at a relatively constant rotational speed. Stick/slip phases may be known to occur with characteristic stick/slip periods during which one stick/slip cycle occurs (i.e., during which the drill string has first the relatively high rotational speed, then the relatively low rotational speed until it starts with the next relatively high rotational speed phase). For example, those characteristic stick/slip periods may be in the range of 5 seconds or 10 seconds. It is well known that between the individual phases with relatively high or low rotational speed, the vibrational response may be considered stationary. As such, the synchronization accuracy of one or more load sensors configured to sense loads related to the vibration of the drill string could be related to the characteristic stick/slip periods. For example, the synchronization of one or more load sensors configured to sense loads related to the vibration of the drill string could be lower than the characteristic stick/slip periods or a portion of the characteristic stick/slip periods (e.g., a percentage of characteristic stick/slip periods), such as lower than 5 seconds or 10 seconds, for example. Synchronization accuracies could be also defined with respect to a cycle of a high-frequency vibration such as HFTO, that is 50 Hz, 100 Hz, or 350 Hz or higher. Accordingly, in accordance with some embodiments of the present disclosure, a means to calculate maxima of HFTO without synchronized measurement at high sample rates is provided.

Embodiments provided herein provide an implementation for HFTO. In accordance with embodiments of the present disclosure, a representative HFTO value is derived that is obtained from more than one, for example two or more, or three or more independent measurements. In some such embodiments, the independent measurements may include acceleration, revolutions per minute of the drill string 20, or other displacement-based measurements and/or strain related measurements, such as torque or the like. It will be appreciated that the torque may comprise a relatively static portion (e.g., the relatively static portion that is related to the torque applied on surface by rotary table 14) and a relatively dynamic portion with higher frequencies corresponding to the HFTO which both may be measured at a sensor position. The dynamic torque may be dependent upon the vibration mode shape (e.g., proportional to the first derivative of the vibration mode shape with respect to the axial position, such as distance from the drill bit, also referred to as distance-from-bit). In some embodiments, one or more of the sensors may be arranged at the same or similar locations on a downhole tool or may be arranged within a fraction of a wavelength of the HFTO mode shape (or fraction offset from a wavelength or wavelength multiple of the mode shape). That is, the distance of the sensing could be a fraction of a wavelength, a wavelength plus a fraction of a wavelength, or a wavelength multiple plus a fraction of the wavelength of the mode shape. As such, it will be appreciated that a single wavelength or whole wavelength is insufficient. For example, the torque sensing and the acceleration sensing can be placed within a wavelength, at the same position, and/or at a wavelength or multiple of a wavelength plus a fraction of a wavelength of the mode shape. Further, in accordance with some embodiments, it might be beneficial to place a torque sensor at a distance to the acceleration sensing that is different by ¼ of a wavelength of the HFTO.

The use of three separate and independent sensors or sensing devices and associated measurements enables identification of the location of an HFTO mode maximum (positive or negative) and/or location of any other vibration mode shape feature relative to the sensors without a synchronization of the measurements from the separate and independent sensors or sensing devices that has an accuracy in the order of the sampling interval of the sensors providing the measurements. In this regard, it may not require a dedicated electrical or bus system to synchronize the measurements and the synchronization of the sensors and/or associated electronic boards would solely rely on internal clocks that are available with a low enough drift at high environmental temperatures (e.g. higher than 100° C., 130° C., or even 150° C.) to provide sufficient synchronization accuracy during the length of typical drilling run (e.g. during 5 days, 10 days, or even 15 days). As such, it may be sufficient to synchronize the sensors and/or associated electronic boards only on that earth's surface (e.g., where the boards are easier accessible and can be connected with additional lab equipment) and no action is executed downhole to synchronize the sensors and/or associated electronic boards.

It may be beneficial, in accordance with some embodiments, to synchronize the measurements with an accuracy within the range of characteristic stick/slip periods. For example, it may be beneficial to synchronize the measurements with an accuracy better than (i.e., lower than) 0.5 seconds, 1 second, 2 seconds, or 5 seconds. Synchronization may include that all measurements that were done within a specific time window corresponding to the accuracy of the measurement synchronization may be averaged. For example, all measurements that were sampled in a 0.1, 0.2, 0.5, or 1 second window may be averaged. Applying a timestamp or associated time information should be accurate with respect to the same time window or synchronization accuracy. For example, the time of a physical measurement and the data derived from such measurement from the different locations along the BHA or drill string may be determined and/or assigned with an accuracy of up to 0.1 seconds, up to 1 second, or up to 2 seconds. However, without stick/slip or a similar low frequency phenomenon that influences the quasi-stationary vibrations, the accuracy can be even worse. For example, the accuracy may be up to 10 seconds, one minute, or greater. Accordingly, the time window or the synchronization accuracy may be longer than described above, for example a time window of 10 seconds, one minute, or greater. In this context, a measure could be applied that compares if the vibration is stationary. For example, a comparison of the amplitudes in different subsequent time frames or the amplitudes at a frequency of the measurement in subsequent time frames. The vibration could be denoted as stationary if the difference in the amplitude in different subsequent time frames is smaller compared to a limit (e.g., 1 g or 1,000 rad/sec$^2$) or ratios (e.g., 10% or 5%). From the measurements, derivative information may be obtained. In some embodiments, more than three sensors may be employed to improve results. In some embodiments, a first sensor may be arranged on a first downhole tool, a second sensor may be arranged on a second downhole tool, and a third sensor may be arranged on a third downhole tool, wherein the first, the second, and the third downhole tools are threadedly connected together by threads about an inner bore of the drill string 20. In some embodiments, two sensors may be arranged on one (i.e., a single) downhole tool and the third sensor may be arranged on a different downhole tool such as, for example, in one downhole tool and a different downhole tool that are threadedly connected together by threads about the inner bore of the drill string 20.

Figure 2A:
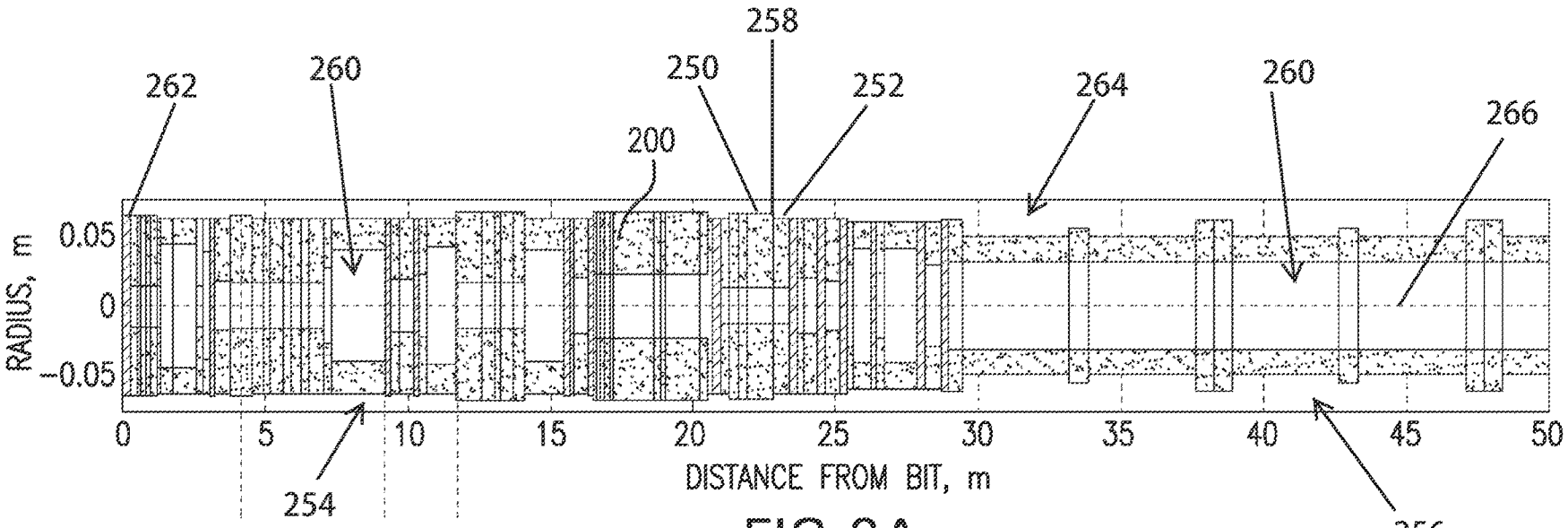
FIG. 2A is a schematic illustration of a downhole system illustrating a shape of the downhole system as a function of distance-from-bit.
Figure 2B:
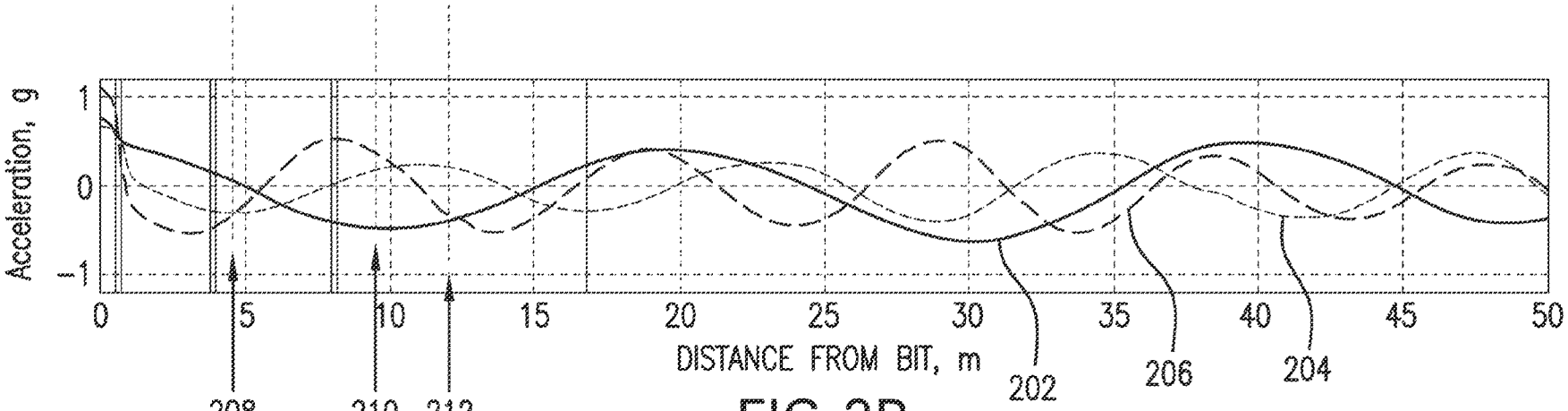
FIG. 2B illustrates example corresponding torsional vibration mode shapes that may be excited during operation of the downhole system of FIG. 2A.

Turning now to FIGS. 2A-2B, an example of a downhole system 200 and corresponding vibration modes (oscillation modes) are shown. In FIGS. 2A-2B, the oscillation is a torsional oscillation, the torsional oscillation having an angular natural frequency. Torsional oscillation is an oscillatory movement of portions of a downhole tool around the longitudinal axis of the downhole tool. Torsional oscillations are associated to angular displacement, angular velocity, angular acceleration, and angular torque. If measured in a tangential direction, the torsional vibration can be measured by a torsional/tangential acceleration sensor or a radial acceleration sensor. Additionally, such torsional vibration may be measured through detection of rotary speed by a magnetometer, or a bending sensor, or similar sensing devices, such as through measurement of the local gravity field. An angle, as referred to with respect to the preceding, is an angle around the longitudinal axis of the downhole tool. FIG. 2A is a schematic plot of a downhole system 200. The downhole system 200 includes one or more downhole tools (e.g., first downhole tool 250 and second downhole tool 252) forming a BHA 254 and/or drill string 256 and that are threadedly connected by threads 258. The downhole tools 250, 252 and other tools of the downhole system 200 may define an inner bore 260 that is configured to provide a pathway for a drilling fluid to flow from the surface through drill string 256, BHA 254, a drill bit 262 at an end of the BHA 254, and through an annulus 264 back to the surface. Some or all of the drill string 256, the BHA 254, and/or the drill bit 262 are configured to rotate about respective longitudinal axis 266. Threads 258 connecting downhole tools (such as first and second downhole tool 250, 252) are circular threads about the inner bore 260. FIG. 2A also illustrates a shape of the downhole system 200 as a function of distance from the drill bit 262, also referred to as distance-from-bit. FIG. 2B illustrates an example of corresponding acceleration mode shapes according to torsional oscillation or vibration mode shapes that may be excited during operation of the downhole system 200 of FIG. 2A.

Torsional oscillations can be observed by observing the torsional acceleration caused by the torsional oscillation. To measure torsional acceleration, acceleration sensors may be used (e.g., accelerometers, inertia sensors, etc.). The angular torque caused by an exciting force acting on the downhole system can be measured by a force or torque sensor. In downhole applications, for example, strain gauges are typically employed, with such strain gauges using magnetostriction, piezo electricity, optic, induction, or capacitance effects to observe strain caused by the angular torque. The acceleration or torque sensor may be located in, on, or along the downhole system. For example, an acceleration or torque sensor may be installed in the collar of a downhole tool (e.g., inside a cavity closed by a hatch cover), at a surface of the downhole tool, or within the inner bore of a downhole tool (e.g., in a probe container (not shown) located within the inner bore of the downhole tool through which the drilling fluid is passing from the mud pump at the surface to the disintegrating tool). Multiple strain sensors can be arranged and, for example, may be collocated to separate the strain measurements caused by an axial force component (e.g., WOB) and a torsional component, or a bending component, or a pressure or temperature component of the strain measurement. The strain gauge sensors can also be placed relative to each other in such a way that they deliver linearly independent measurements. For example, linearly dependent measurements could be for strain measurements that are measured in the same direction with respect to the tool axis.

As illustratively shown in FIG. 2A, the downhole system 200 has various components with different shapes (along with differing diameters, material properties, such as masses, densities, Young's modulus, shear modulus, spring constants, configurations, etc.) and thus during rotation of the downhole system 200, different components may cause various torsional oscillation modes to be generated. The illustrative vibration mode shapes indicate where the highest acceleration amplitudes will exist for different modes and angular natural frequencies. For example, as shown in FIG. 2B, a first torsional vibration or oscillation mode shape 202 having a first frequency, a second torsional vibration or oscillation mode shape 204 having a second frequency, and a third torsional vibration or oscillation mode shape 206 having a third frequency of the downhole system 200 are shown. The vibration mode shapes provide the distribution of the amplitude of torsional acceleration along the BHA or drill string, also referred to as torsional load. The torsional acceleration, force, torque, or load at higher frequencies are named high frequency torsional acceleration, force, torque, or loads. The load distribution (in FIG. 2B, the torsional acceleration) along a downhole system, as shown by the torsional vibration or oscillation mode shapes 202, 204, 206, may vary based on the placement of various components along the downhole system.

In accordance with embodiments of the present disclosure, the distribution of the load along a downhole system (e.g., BHA, drill string, etc.) may be represented by the distance-from-bit, and may be illustratively represented by trigonometric functions (e.g., sine and cosine) with different wavelengths along the downhole system, as shown in FIG. 2B. For example, as can be seen from FIG. 2B, the mode shape 202, 204, and 206 have wavelengths of approximately 20 m, 14 m, and 9 m, respectively, which can be measured as a distance from a maximum of a mode shape to a successive maximum of the same mode shape. As used herein, a measured angular acceleration is represented as $\ddot{\varphi}_{s,i}(x)$ and a measured dynamic torque is $M_{t,i}(x)$, each as a function of distance-from-bit x, wherein index i is a sequential number referring to the i-th vibration mode with a frequency $f_i$ (i=1 . . . N). For every vibration mode/vibration mode shape, the measured vibration amplitude is equal to the sum of all modes It is noted that the measurements may be made by one or more appropriate sensors (e.g., acceleration sensors, torque sensors, etc.) located at a distance-from-bit x along the downhole system 200. However, as noted, the location of the sensor (distance-from-bit x) will impact the information obtained by the specific sensor.

Embodiments provided herein take advantage of the fact that the dynamic torque $M_{t,i}(x)$ is proportional to the first derivative of the angular displacement $\varphi_{s,i}(x)$ with respect to the distance-from-bit x:

$$M_{t,i} = \frac{d\varphi_{s,i}}{dx} GI \tag{1a}$$

In equation (1a), I is the second moment of area (see, e.g., equation (8) below) and G the shear modulus. Further, a harmonic angular acceleration (vibration) versus the time t is represented as:

$$\ddot{\varphi}_{s,i}(x,t)=\omega_{0,i}^2\cdot\varphi_{s,i}(x)\cdot\sin(\omega_{0,i}t+\Phi_i) \tag{1b}$$

In equation (1b), $\omega_{0,i}$ is the angular natural frequency, $\Phi_i$ is the phase shift and a point denotes a derivation with respect to time.

Along the distance-from-bit x, three scenarios can occur for an analytical model for different measurement positions. With reference again to FIGS. 2A-2B, a first measurement position 208, a second measurement position 210, and a third measurement position 212 are shown, with respective vibration mode shapes at the specific distance-from-bit x. For example, at the first measurement position 208, the first vibration mode shape 202 is close to zero so that zero (or near zero) angular acceleration is measured and—according to equation (1a)—a maximum dynamic torque would be measured, as appreciated by those of skill in the art, for the first vibration mode shape 202. At the second position 210, for example, a maximum angular acceleration amplitude is measured for the first vibration mode shape 202, but zero (or near zero) dynamic torque would be present. Finally, at the third position 212, for example, a general case may exist, wherein some amount angular acceleration would be measured and some amount of dynamic torque would be measured for the first vibration mode shape 202.

In each of these cases at least one measured load (e.g., angular acceleration or dynamic torque) is significantly lower than the maximum occurring along the downhole system 200. That is, no case or no distance-from-bit x exists where a zero angular acceleration and a zero dynamic torque are simultaneously measured. The distribution of the angular acceleration amplitude along the distance-from-bit x and the dynamic torque amplitude along the distance-from-bit x is orthogonal to each other. That is, if normalized to a maximum of angular acceleration or dynamic torque, an approximation of the vector sum of both loads is equal to 1 for every distance-from-bit x (if a constant diameter and other constant characteristics are given).

Knowing this, a relationship between the angular acceleration and the dynamic torque may be established that enables an accurate estimation of downhole vibrations. Further, as described below, the distance-from-bit x can be eliminated as a variable for the estimation, and thus the placement of one or more sensors can be optimized based on system configurations, and not dependent on specific mathematics or desired accuracy of estimations.

In a model of a torsional oscillator being a tube or similar structure, the characteristics of torsional oscillator may be as follows: outer diameter $D_o$, inner diameter $D_i$, length L, density ρ, Young's Modulus E, and shear modulus G. In the below description of the model torsional oscillator, the boundary conditions on both sides/ends are free. In this example, the results of the torsional oscillation model (e.g., graphical user interface employed by operator to adjust drilling operations) are calculated using a finite element model and are compared with an analytical model. The following discussion will analyze a torsional oscillator model instead of a whole BHA for the sake of simplicity and also because the analytical analysis of a BHA might not be feasible due to non-homogeneity. The analysis takes into consideration all results given by a graphical user interface that an operator may be using to estimate downhole vibrations and making decisions therefrom. For example, a graphical user interface may provide oscillation frequencies and critical slope values as well as the oscillation or vibration mode shapes, the torques, and the angular accelerations.

As used herein, a vibration mode shape i of the angular displacement $\varphi_i$ is as follows, with rank of the vibration mode shape i sorted by angular natural frequency, downhole system or tool length L, and distance-from-bit x:

$$\varphi_i \sim \cos\left(\frac{\pi}{L} ix\right) \tag{2}$$

The mass normalized vibration mode shape $\overline{\varphi}_i$ is as follows, with density ρ of the downhole system/tool, tool outer diameter $D_o$, and tool inner diameter $D_i$:

$$\overline{\varphi}_i = \frac{8}{\sqrt{\pi\rho L(D_o^4 - D_i^4)}}\cos\left(\frac{\pi}{L} ix\right) \tag{3}$$

The frequency f of a given vibration mode shape i is:

$$f_{0,i} = \frac{\omega_{0,i}}{2\pi} = \frac{i}{2L}\sqrt{\frac{G}{\rho}} \tag{4}$$

The angular frequency $\omega_{0,i}$ of a given vibration mode shape i is as follows, with shear modulus G:

$$\omega_{0,i} = \frac{\pi}{L} i\sqrt{\frac{G}{\rho}} \tag{5}$$

A critical slope value $S_{c,i}$ is:

$$S_{c,i} = -\frac{1}{32}\pi^2 iD_i\sqrt{G\rho}\,(D_o^4 - D_i^4) \tag{6}$$

A tangential torque $M_t$ is:

$$M_{t,i} = \frac{d\overline{\varphi}_{s,i}}{dx} GI \tag{7}$$

In equation (7) (and equation (1a) above), the second moment of area I is expressed as:

$$I = \frac{\pi}{32}\left(D_o^4 - D_i^4\right) \tag{8}$$

It is assumed that the angular velocity at the bit at the angular frequency $\omega_{0,i}$ is equal to the average bit angular velocity (in revolutions per minute ("RPM")) divided by $\omega_{0,1}$:

$$\hat{\varphi}_{s,i} = \frac{2\pi}{60}RPM\frac{1}{\omega_{0,i}} = \frac{2\pi}{60}RPM\frac{L}{i\pi}\sqrt{\frac{\rho}{G}} \tag{9}$$

In equation (9), $\hat{\varphi}_{s,i}$ is the maximum value along the tube of the angular deflection corresponding to the vibration mode shape i. As such, the scaled angular deflection $\overline{\varphi}_{s,i}$, with respect to the distance-from-bit x, can be expressed as:

$$\overline{\varphi}_{s,i} = \hat{\varphi}_{s,i}\cos\left(\frac{\pi}{L}ix\right) = \frac{2\pi}{60}RPM\frac{L}{i\pi}\sqrt{\frac{\rho}{G}}\cos\left(\frac{\pi}{L}ix\right) \tag{10}$$

Consequently, the first derivation of the scaled angular deflection $\overline{\varphi}_{s,i}$ is:

$$\frac{d\overline{\varphi}_{s,i}}{dx} = -\frac{2\pi}{60}RPM\sqrt{\frac{\rho}{G}}\sin\left(\frac{\pi}{L}ix\right) \tag{11}$$

Thus, the torque is $M_{t,i}$ is:

$$M_{t,i} = -\frac{2\pi}{60}RPM\sqrt{\frac{\rho}{G}}\,G\frac{\pi}{32}\left(D_o^4 - D_i^4\right)\sin\left(\frac{\pi}{L}ix\right) \tag{12}$$

or $$M_{t,i} = -\frac{\pi^2}{960}RPM\left(D_o^4 - D_i^4\right)\sqrt{\rho G}\sin\left(\frac{\pi}{L}ix\right) \tag{13}$$

Further, angular accelerations $A_\alpha$ is:

$$A_{\alpha,i} = \frac{d^2\overline{\varphi}_{s,i}}{dt^2} = \ddot{\overline{\varphi}}_{s,i} \tag{14}$$

$$\ddot{\overline{\varphi}}_{s,i} = \omega_{0,i}^2\overline{\varphi}_{s,i} = \omega_{0,i}^2 k\overline{\varphi}_i = \omega_{0,i}^2\frac{2\pi}{60}RPM\frac{1}{\omega_{0,i}}\cos\left(\frac{\pi}{L}ix\right) \tag{15}$$

$$\ddot{\overline{\varphi}}_{s,i} = \omega_{0,i}\frac{2\pi}{60}RPM\cos\left(\frac{\pi}{L}ix\right) \tag{16}$$

Torsional/tangential acceleration $A_t$, at a radius r and time t, is:

$$A_{t,i} = r\frac{d^2\overline{\varphi}_{s,i}}{dt^2} = rA_{\alpha,i} \tag{17}$$

$$\ddot{\overline{\varphi}}_{s,i} = \omega_{0,i}^2\overline{\varphi}_{s,i} = \omega_{0,i}^2 k\overline{\varphi}_i = \omega_{0,i}^2\frac{2\pi}{60}RPM\frac{1}{\omega_{0,i}}\cos\left(\frac{\pi}{L}ix\right) \tag{18}$$

$$A_{t,i} = r\omega_{0,i}\frac{2\pi}{60}RPM\cos\left(\frac{\pi}{L}ix\right) \tag{19}$$

Radial accelerations $A_r$, with velocity v, is:

$$A_{r,i} = \frac{v_i^2}{r} \tag{20}$$

$$v_i = r\dot{\overline{\varphi}}_{s,i} = r\omega_{0,i}\overline{\varphi}_{s,i} = r\omega_{0,i}k\overline{\varphi}_i = r\omega_{0,i}\frac{2\pi}{60}RPM\frac{1}{\omega_{0,i}}\cos\left(\frac{\pi}{L}ix\right) \tag{21}$$

$$v_i = r\frac{2\pi}{60}RPM\cos\left(\frac{\pi}{L}ix\right) \tag{22}$$

$$A_{r,i} = r\left(\frac{2\pi}{60}RPM\cos\left(\frac{\pi}{L}ix\right)\right)^2 \tag{23}$$

Using the above equations, and analytical testing and modeling, it has been determined that an accurate estimation of downhole vibrations (e.g., high frequency torsional oscillations, lateral vibrations, axial vibrations, etc.) may be obtained, independent from sensor position relative to a bit. Thus, improved mitigation of downhole vibrations may be achieved based on angular acceleration and torque detection, without the need for additional information.

A ratio of angular acceleration to torque is independent of the actual amplitude and a constant value for a given angular frequency ω and corresponding mode. Further it is independent of the length L of the drilling system. As such:

$$\frac{\hat{\ddot{\varphi}}}{\hat{M}} = \frac{1}{\frac{1\pi}{\omega_{0,i}32}\sqrt{\rho G}\left(D_o^4 - D_i^4\right)} = \omega_{0,i}\cdot K \tag{24}$$

In equation (26), $\hat{\ddot{\varphi}}$ is a maximum amplitude of the angular acceleration along the tube, $\hat{M}$ is a maximum amplitude of the dynamic torque along the tune, and $$K = \frac{1}{\frac{1\pi}{\omega_{0,i}32}\sqrt{\rho G}\left(D_o^4 - D_i^4\right)}.$$

Further, as stated above, because of the orthogonality of angular acceleration and dynamic torque (e.g., sine vs. cosine) with respect to the distance-from-bit x the following relationship is applicable:

$$\sqrt{\left(\frac{\hat{\ddot{\varphi}}}{\hat{\ddot{\varphi}}}\right)^2 + \left(\frac{M}{\hat{M}}\right)^2} = 1^2 \tag{25}$$

From the above, i.e., from equations (24) and (25), the following equation (26) can be derived by multiplying with maximum amplitude $\hat{\ddot{\varphi}}$ of angular acceleration along the tube:

$$\hat{\ddot{\varphi}} = \sqrt{\ddot{\varphi}^2 + \left(\frac{\hat{\ddot{\varphi}}}{\hat{M}}\right)^2 M^2} = \sqrt{\ddot{\varphi}^2 + \omega_{0,i}^2 K^2 M^2} \tag{26}$$

Although the above has been described with respect to angular acceleration, the same principle and process can be applied to measured vibration within the downhole tool (e.g., BHA and/or drill string).

Moreover, a similar approach can be used to determine the maximum dynamic torque amplitude $\hat{M}$ along the tube:

$$\hat{M} = \sqrt{\left(\frac{M}{\hat{\ddot{\varphi}}}\right)^2 \ddot{\varphi}^2 + M^2} = \sqrt{\frac{1}{\omega_{0,i}^2 K^2}\ddot{\varphi}^2 + M^2} \tag{27}$$

The above equations were derived from a homogenous structure (or theoretical structure). However, such concepts can be applied to non-homogeneous structures (e.g., real-world BHA, drill string, etc.). From measurements of torque M and angular acceleration at the same location, the maximum dynamic torque amplitude $\hat{M}$ and the maximum angular acceleration $\hat{\ddot{\varphi}}$ can be derived. Knowing the maximum dynamic torque amplitude and the maximum angular acceleration, a reasonable estimation of downhole vibration may be obtained, and thus an operator may adjust a drilling operation accordingly. The maximum dynamic torque amplitude $\hat{M}$ and the maximum amplitude of angular acceleration $\hat{\ddot{\varphi}}$ are representative values in accordance with embodiments of the present disclosure. It is to be noted that the determined maximum dynamic torque amplitude $\hat{M}$ as well as the maximum amplitude of angular acceleration $\hat{\ddot{\varphi}}$ are independent of the length L of the downhole system and are independent of the position of the load sensors along the longitudinal axis of the downhole system relative to the bit.

Although the above description is based on the sensors being located at the same distance-from-bit (or even at the same location), such configuration is not required. That is, in some embodiments, the sensors may be located at different positions and/or distances from bit.

In such arrangement, $$\kappa = \frac{\pi i}{L} = \sqrt{\rho/G}\,\omega_{0,i},$$

and the torque is $$M_{t,i}(x+\Delta x) = -\frac{\pi^2}{960} RPM\left(D_o^4 - D_i^4\right)\sqrt{\rho G}\sin\left(\frac{\pi}{L} i(x+\Delta x)\right) = \hat{M}\sin(\kappa(x+\Delta x)) = \frac{\hat{\ddot{\varphi}}}{\omega_{0,i}K}\sin(\kappa(x+\Delta x)).$$

The torque may be substituted by the angular acceleration measurement with the knowledge of the angular frequency $\omega_{0,i}$ and the ratio K. As such, the angular acceleration can be derived to $$\ddot{\varphi}(x) = \omega_{0,i}\frac{2\pi}{60} RPM\cos\left(\frac{\pi}{L} ix\right) = \hat{\ddot{\varphi}}\cos(\kappa x).$$

In this embodiment, a first load sensor (e.g., first torque or acceleration sensor) is placed at a different distance-from-bit ("DfB") x+Δx with respect to a second load sensor(s) (e.g., second torque or acceleration sensor) that are placed at DfB x. With $$\ddot{\varphi}(x) = \hat{\ddot{\varphi}}\cos(\kappa x) \rightarrow \hat{\ddot{\varphi}} = \frac{\ddot{\varphi}(x)}{\cos(\kappa x)}$$

the torque can be derived by $$M(x+\Delta x) = \frac{\ddot{\varphi}(x)}{\cos(\kappa x)\omega_{0,i}K}\sin(\kappa(x+\Delta x)) \rightarrow \frac{M(x+\Delta x)}{\frac{\ddot{\varphi}(x)}{\omega_{0,i}K}} =$$

$$\frac{\sin(\kappa(x+\Delta x))}{\cos(\kappa x)} = \frac{\sin(\kappa x)\cos(\kappa\Delta x) + \cos(\kappa x)\sin(\kappa\Delta x)}{\cos(\kappa x)} \rightarrow \frac{M(x+\Delta x)}{\frac{\ddot{\varphi}(x)}{\omega_{0,i}K}} =$$

$$\tan(\kappa x)\cos(\kappa\Delta x) + \sin(\kappa\Delta x) \rightarrow \tan(\kappa x) =$$

$$\frac{\frac{\omega_{0,i}KM(x+\Delta x)}{\ddot{\varphi}(x)} - \sin(\kappa\Delta x)}{\cos(\kappa\Delta x)} \rightarrow x = \operatorname{atan}\left(\frac{\frac{\omega_{0,i}KM(x+\Delta x)}{\ddot{\varphi}(x)} - \sin(\kappa\Delta x)}{\cos(\kappa\Delta x)}\right).$$

Herein, the DfB x and x+Δx of the respective second and first sensors is unknown and can be calculated when the distance between both sensors Δx is known. The well-known function a tan 2 has to be used because the equation is case sensitive with respect to the signs. The ratio $$\frac{\ddot{\varphi}(x)}{M(x)} = \frac{-32\omega_{0,i}}{\pi\left(D_o^4 - D_i^4\right)\sqrt{\rho G}}\frac{\cos(\kappa x)}{\sin(\kappa x)}$$

can be used to calculate the dynamic torque M(x) (which has not been measured and is only known at M(x+Δx)). With the knowledge of the dynamic torque M(x) and the angular acceleration $\ddot{\varphi}(x)$ at one position the same equations as shown above apply to calculate the maximum dynamic torque and maximum angular acceleration:

$$\hat{M} = \sqrt{\left(\frac{\hat{M}}{\hat{\ddot{\varphi}}}\right)^2 \ddot{\varphi}^2 + M^2} = \sqrt{\frac{1}{\omega_{0,i}^2 K^2}\ddot{\varphi}^2 + M^2}$$

$$\hat{\ddot{\varphi}} = \sqrt{\ddot{\varphi}^2 + \left(\frac{\hat{\ddot{\varphi}}}{\hat{M}}\right)^2 M^2} = \sqrt{\ddot{\varphi}^2 + \omega_{0,i}^2 K^2 M^2}$$

A similar approach can be used if two accelerometers or two torque sensors are used that are placed at two different DfB (or any other sensor that is able to measure torsional oscillations). Moreover, the same assumptions are true for other types of vibrations. Furthermore, it is noted and will be appreciated by those of skill in the art, in view of the teachings herein, that the amount of energy in different frequencies of HFTO can be determined by the algorithm presented herein. The values obtained for each or any given frequency may be employed to provide an indicator for formation detection (e.g., for stringers). It will be appreciated that by using the equations described herein, a synchronization of the sensing with respect to a sampling and/or bandwidth is necessary and at least two sensing devices are needed.

Figure 3A:
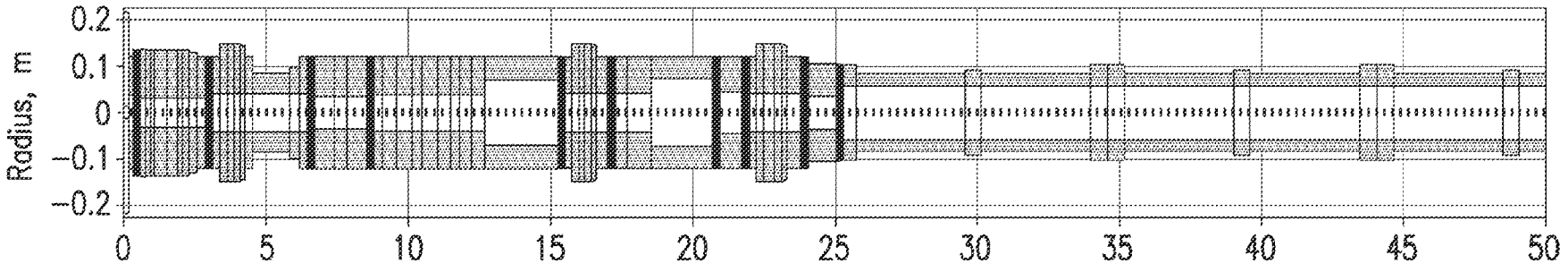
FIG. 3A is a schematic illustration of a downhole system illustrating a shape of the downhole system as a function of distance-from-bit.
Figure 3B:
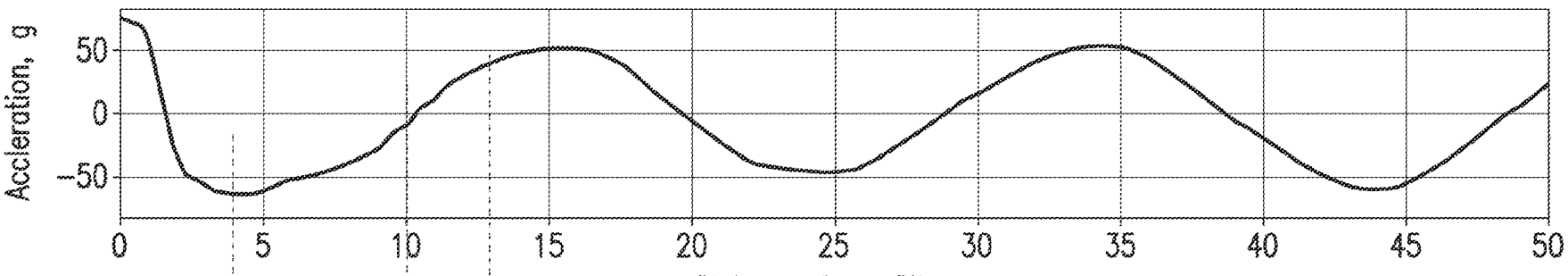
FIG. 3B illustrates an example of acceleration corresponding to a vibration mode shape that may be excited during operation of the downhole system of FIG. 3A.
Figure 3C:
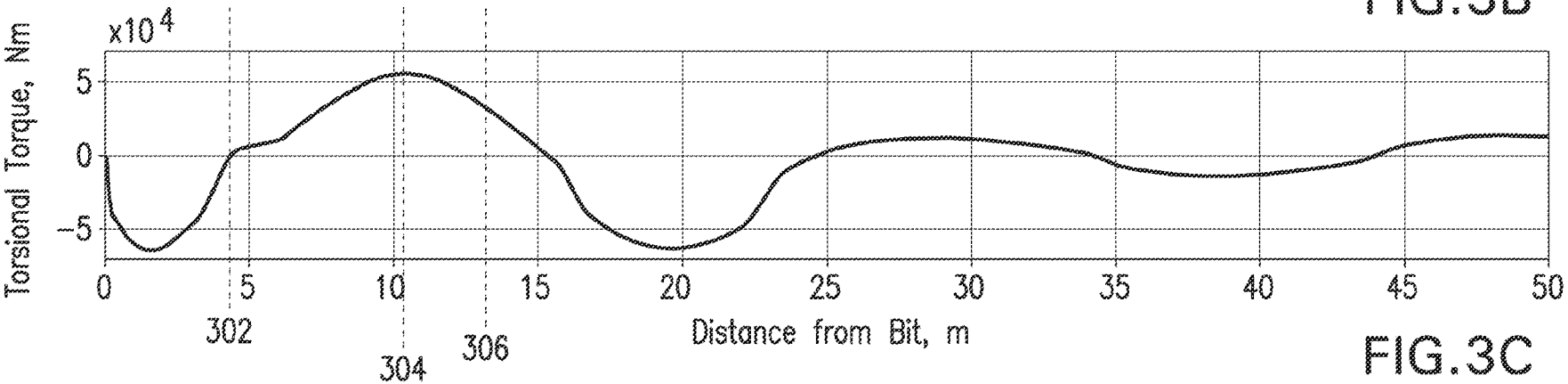
FIG. 3C illustrates an example of dynamic torque corresponding to a vibration mode shape that may be excited during operation of the downhole system of FIG. 3A.

Turning now to FIGS. 3A-3C, an example BHA having a torsional/tangential acceleration amplitude and the dynamic torque is shown. In this example, a rotary speed of 100 RPM at the bit was assumed. Theoretically, the bit RPM scales the loads linearly, such that loads at 200 RPM are doubled as compared to the loads at 100 RPM. The corresponding mode has a frequency of $f_{0,i}$=142.1 Hz and $\omega_{0,i}=2\pi f_{0,i}$. In this example, point 302 represents a point where maximum (negative) angular acceleration is measured and zero or almost zero (i.e., relatively low) dynamic torque is measured; point 304 represents a location where zero or almost zero (i.e., relatively low) angular acceleration amplitude and maximum (positive) dynamic torque amplitude is measured; and point 306 represents a "general case" having some amount of measured angular acceleration amplitude and dynamic torque amplitude. It is noted that the orthogonality assumption between dynamic torque and torsional/tangential acceleration measurement is valid.

A comparison between theoretical amplitudes for 100 RPM derived with a mathematical model (e.g., a Finite Difference Model or a Finite Element Model of the drill string) and the approach of embodiments provided herein are shown in FIGS. 4A-4F. In each plot, a critical slope value and natural frequency are provided above the plots. The plots are separated into pairs for estimations of angular acceleration (FIGS. 4A, 4C, 4E) and dynamic torque (FIGS. 4B, 4D, 4F), which can be combined to estimate downhole vibration of the system and thus enabling an operator to adjust a drilling operation to mitigate the downhole vibration. The calculation of the representative value(s) is done in real time during the drilling operation.

In accordance with some embodiments of the described method and processes, a processor in the downhole tool may be employed and located downhole such that implementation may be executed downhole. In some such embodiments, the determined representative value (e.g., maximum load) may be communicated uphole (e.g., to a surface control unit) and mitigating procedures may be automatically performed. Such automatic mitigation procedures may include, without limitation, changing operational parameters to reduce a determined maximum load in response to the communicated load information, for example, exceeding or being equal to a predetermined load limit for a specific downhole tool in the string. Further still, in some embodiments, instead of communicating the representative values to the surface, a downhole processor may communicate information about required operation parameter changes to uphole (e.g., to a surface control unit). In some such embodiments, information about operation parameter changes are received uphole and operation parameter changes may be automatically performed without the interaction of a human being (e.g., operator). Using the downhole processor to perform the calculations in real time while drilling the borehole, the processor needs to know the geometry and material property parameters required to assume the homogeneous structure of the downhole tool (torsional oscillation model).

In accordance with some embodiments, a wired pipe drilling operation provides high bandwidth data transmission. The high bandwidth data transmission may be high enough to transmit the sensor data (e.g., at a high sample rate, such as 1000 Hz or faster) to the surface for uphole or surface data processing. A surface processor (e.g., located in a surface control unit) can perform the described calculations and can provide the representative value(s) to an operator or to an electronic controller that applies a change in operation parameter(s), if required.

In some embodiments, a surface control unit may generate an alert or provide advice or recommendations to an operator based on the transmitted (received) information. As such, the operator may be made aware of the need to take action to reduce vibration downhole. For example, in some embodiments, an alert may be generated when the transmitted information contains a maximum acceleration amplitude or torque amplitude that equals or exceeds a predetermined threshold. Alternatively, in some embodiments, for example, the transmitted information from downhole to uphole may include severity level information. The severity level information may be an indicator indicating that severe downhole vibration is detected (e.g., torsional vibration, axial vibration, lateral vibration). The severity level information may also give information on how severe the vibration is (e.g., indication of acceleration and/or torque amplitudes, vibration frequency). The severity level information may also include levels of severity. For example, the levels of severity may be predefined numbers of classes that are assigned to a severity interval (e.g., an acceleration amplitude and/or torque amplitude interval). Sending the severity level information may require much less telemetry bandwidth than transmitting the actual measurement value. The severity level information may be defined based on the determined acceleration and/or torque amplitudes calculated using embodiments described herein.

In accordance with some embodiments, calculated acceleration or torque data may be stored downhole in a memory in the downhole system. Such stored data may be downloaded after a drilling operation. The calculated data may also be stored uphole in a memory in a surface control unit or any other memory, including the internet or a cloud data system. The calculated data may be used for lifetime determination of the downhole system and for making re-run decisions after retrieving the downhole system from the borehole. The calculated data may also be used for updating threshold acceleration and/or threshold torque data used as preset threshold data for future drilling operations.

Figure 4A:
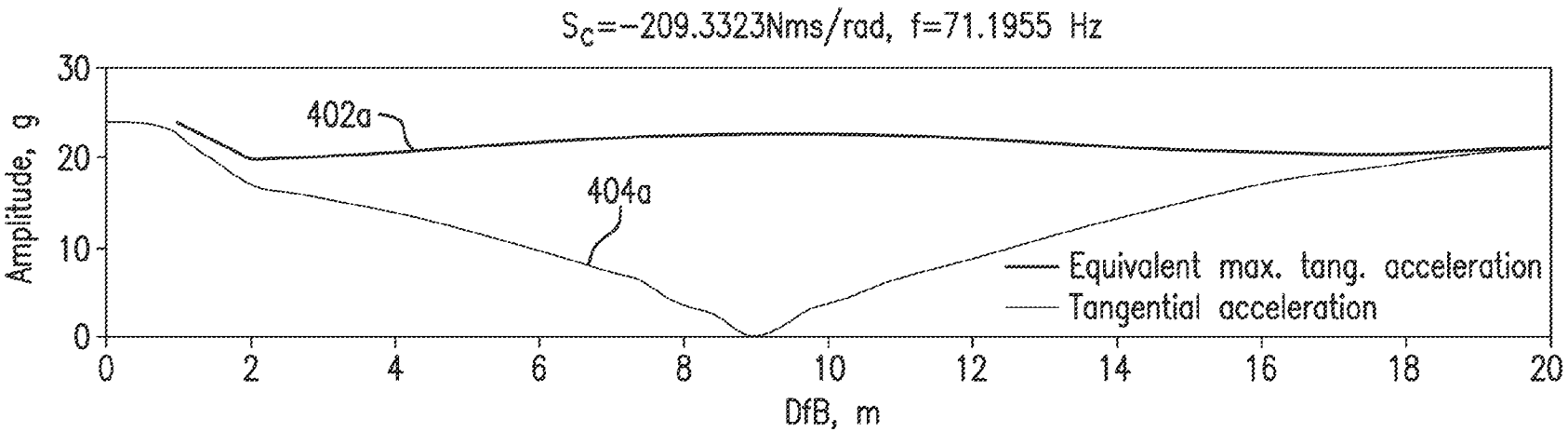
FIG. 4A is a schematic plot illustrating a comparison between the analytical analysis in accordance with an embodiment of the present disclosure and an actual acceleration measurement.
Figure 4B:
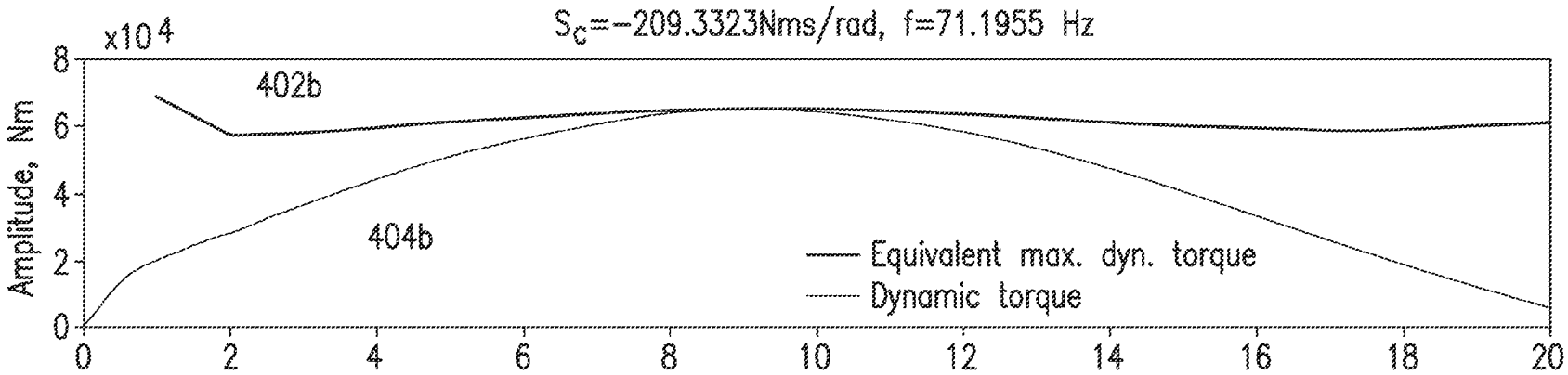
FIG. 4B is a schematic plot illustrating a comparison between the analytical analysis in accordance with an embodiment of the present disclosure and an actual torque measurement.
Figure 4C:
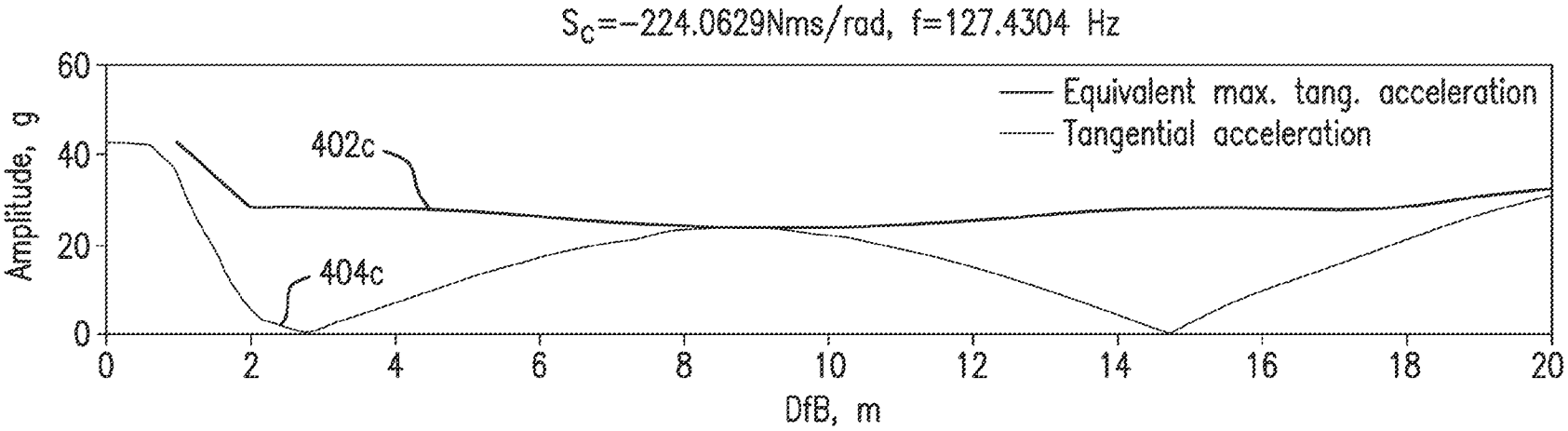
FIG. 4C is a schematic plot illustrating a comparison between the analytical analysis in accordance with an embodiment of the present disclosure and an actual acceleration measurement.
Figure 4D:
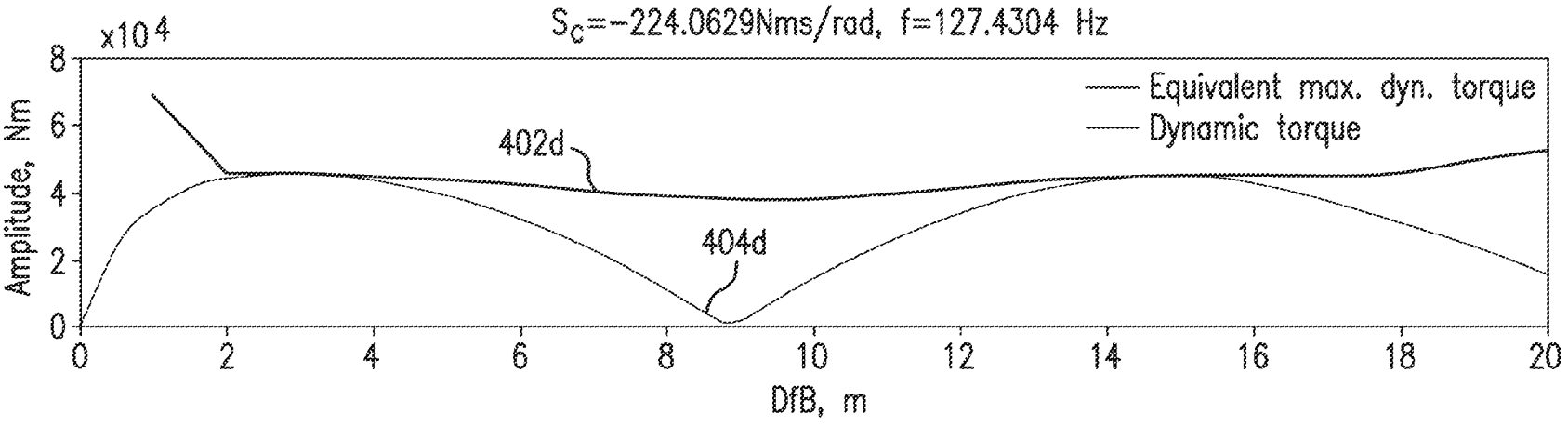
FIG. 4D is a schematic plot illustrating a comparison between the analytical analysis in accordance with an embodiment of the present disclosure and an actual torque measurement.
Figure 4E:
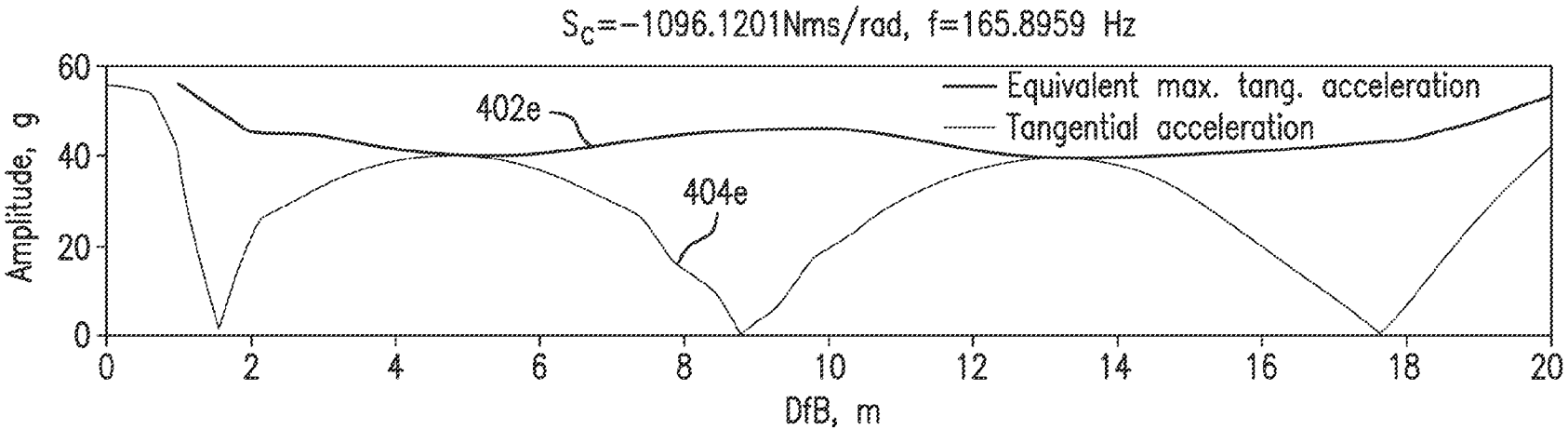
FIG. 4E is a schematic plot illustrating a comparison between the analytical analysis in accordance with an embodiment of the present disclosure and an actual acceleration measurement.
Figure 4F:
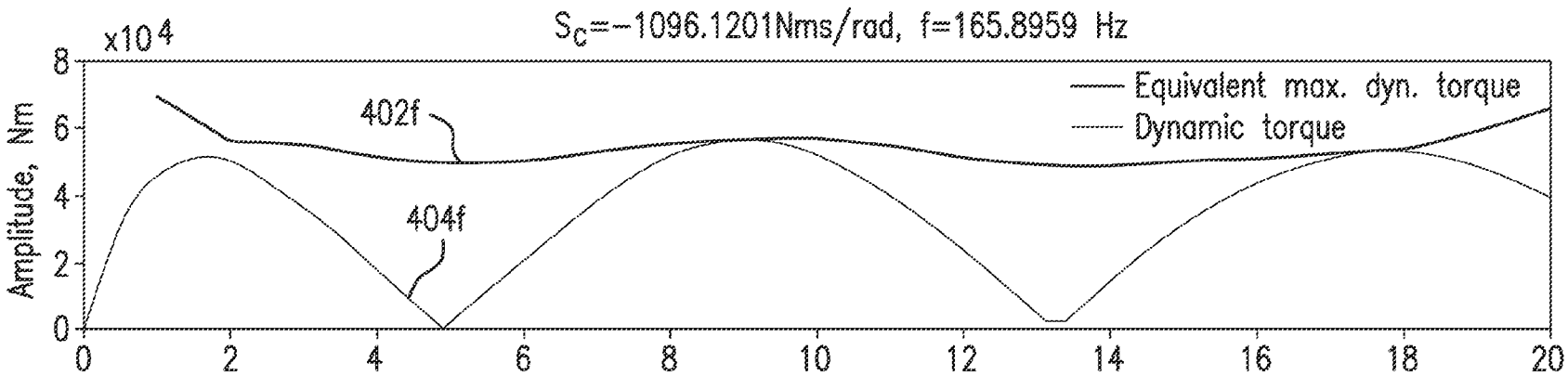
FIG. 4F is a schematic plot illustrating a comparison between the analytical analysis in accordance with an embodiment of the present disclosure and an actual torque measurement.

Referring again to plots 4A-4F, in each plot, the horizontal axis is distance-from-bit and the vertical axis is either acceleration amplitude (FIGS. 4A, 4C, 4E) or torque amplitude (FIGS. 4B, 4D, 4F). Curves 404*a*, 404*c*, and 404*e* show measured accelerations and curves 404*b*, 404*d*, and 404*f* show measured torque amplitudes along the BHA or drill string. The measured curves 404*a*-404*f* illustrate different modes and their associated mode shapes for three different frequencies. The mode shapes shown by curves 404*a*-404*f* have various maxima along the BHA or drill string. The curves 402*a*, 402*c*, and 402*e* illustrate results of a determination of maximum acceleration along the BHA or drill string according to the methods described herein versus the distance-from-bit of one of the sensors utilized to estimate the maximum acceleration. In a similar way, curves 402*b*, 402*d*, and 402*f* illustrate results of a determination of maximum torque along the BHA or drill string according to the methods described herein versus the distance-from-bit of one of the sensors utilized to estimate the maximum acceleration. Notably, the measurement and/or calculation of curves 404*a*-404*f* is typically not available downhole as such calculations require a measurement framework and/or computing power (e.g., processor resources) that is typically not part of a downhole BHA or drill string. In particular, it is not possible to perform numeric simulations downhole that solve finite difference equations related to differential equations as this requires much more processor resources than is typically available under downhole conditions.

As illustrated, the estimated maximum acceleration along the BHA or drill string (402*a*, 402*c*, and 402*e*) and the maximum torque values along the BHA or drill string (402*b*, 402*d*, and 4020 match with the measured maximum values in curves 404*a*-404*f*, regardless or independent from distance-from-bit. Accordingly, sensors used in embodiments of the present disclosure can be placed at any given location and will not impact the calculation and/or determination of the downhole vibration (e.g., the maximum torque and/or acceleration along the BHA or drill string). Being independent from distance to the bit refers to more than one location along the downhole system or drill string or more than one distance from the bit in a direction of the longitudinal axis of the downhole system or drill string where a sensor (acceleration and/or torque) can be located and the herein disclosed calculation will be providing the same result (i.e., maximum acceleration or maximum torque).

The measurement loads of torsional oscillation require placement of the sensor(s) in an off-axis position with respect to the longitudinal rotational axis of the downhole tool (longitudinal axis of rotational symmetry). An off-axis position has a radial distance to the longitudinal rotational axis of the downhole tool which is non-zero. The largest radial distance that the torsional load sensor may have from the longitudinal rotation axis of the downhole tool is half of the outer diameter of the downhole tool. Other than the torsional load sensor, an axial load and/or a lateral load sensor can be located on the longitudinal rotational axis of the downhole tool. A radial distance of an axial load and/or a lateral load sensor to the longitudinal rotational axis of the downhole tool may be zero or any other value between zero and half of the outer diameter of the downhole tool.

In accordance with the present disclosure, the sensor(s) may be located somewhere in the downhole system at a specific distance to the bit, meaning the sensor may be located at a radius r from the central longitudinal axis of the downhole system and/or may be located a circumferential angle $\varphi$ around the longitudinal axis of the downhole system. A separation distance $\Delta x$ between the first sensor (e.g., an acceleration sensor) and the second sensor (e.g., a torque sensor) is measured parallel to the longitudinal axis of the downhole system or drill string, also referred to as an axial distance between the sensors. The first and second sensors may also be located at different circumferential angles $\alpha_1$ and $\alpha_2$ at the same or different specific axial locations or distances, with an angular separation distance between the sensors (e.g., an angular separation distance about the circumference of the drill string). A first load sensor (e.g., an acceleration sensor) and a second load sensor (e.g., a torque sensor) may be located at different radial distances at the same or different specific axial distances, thus having a radial separation distance between the first and second sensor. In some embodiments, the two load sensors, may be located or positioned at the same axial distance from the bit (i.e., axial separation distance between sensors is close or even zero) and may have an angular and/or a radial separation distance to each other, which is non-zero. In another example, there may additionally also be an axial separation distance between the sensors which is non-zero or not even close. The distance or separation between two sensors may be referred to as a sensor distance, with the sensor distance being axial (i.e., axial separation distance along the BHA or drill string), circumferential (i.e., angular separation distance about the longitudinal axis along an arc length, such as a string circumference), and/or radial (i.e., radial separation distance along a radius of the longitudinal axis of the drill string). The sensor distance may be non-zero or not close in one dimension (e.g., same axial and/or circumferential position) or may be non-zero or not close in both dimensions.

In some non-limiting examples, in accordance with embodiments of the present disclosure, distances for a load sensor from the bit is 1 cm to 30 cm, 30 cm to 50 cm, 50 cm to 1 m, 1 m to 3 m, 3 m to 6 m, 6 m to 10 m, 10 m to 20 m, 20 m to 50 m, or 50 m to 100 m. Example distances between two load sensors, in accordance with embodiments of the present disclosure, are 1 cm to 10 cm, 10 cm to 20 cm, 20 cm to 30 cm, 30 cm to 50 cm, 50 cm to 1 m, 1 m to 5 m, 5 m to 10 m, 10 m to 20 m, or 20 m to 30 m. Example angular distances about a drill string circumference between two load sensors, in accordance with embodiments of the present disclosure, are 1 degree to 10 degree, 10 degree to 30 degree, 30 degree to 60 degree, 60 degree to 90 degree, 90 degree to 120 degree, 120 degree to 150 degree, or 150 degree to 180 degree.

FIG. 4A is a plot illustrating an equivalent maximum tangential acceleration 402*a* (analytical value) and a tangential acceleration critical mode 404*a* (measured value) with a stability index of −209.3323 Nms/rad, and a natural frequency of 71.1955 Hz. FIG. 4B is a plot illustrating an equivalent maximum dynamic torque 402*b* (analytical value) and a dynamic torque critical mode 404*b* (measured value) with a stability index of −209.3323 Nms/rad, and a natural frequency of 71.1955 Hz.

FIG. 4C is a plot illustrating an equivalent maximum tangential acceleration 402*c* and a tangential acceleration critical mode 404*c* with a stability index of −224.0629 Nms/rad, and a natural frequency of 127.4304 Hz. FIG. 4D is a plot illustrating an equivalent maximum dynamic torque 402*d* and a dynamic torque critical mode 404*d* with a stability index of −224.0629 Nms/rad, and a natural frequency of 127.4304 Hz.

FIG. 4E is a plot illustrating an equivalent maximum tangential acceleration 402*e* and a tangential acceleration critical mode 404*e* with a stability index of −1096.1201 Nms/rad, and a natural frequency of 165.8959 Hz. FIG. 4F is a plot illustrating an equivalent maximum dynamic torque 402*f* and a dynamic torque critical mode 404*f* with a stability index of −1096.1201 Nms/rad, and a natural frequency of 165.8959 Hz.

The analytical lines 402*a*, 402*b*, 402*c*, 402*d*, 402*e*, 402*f* illustrate plots of the equivalent maximum load value (e.g., tangential acceleration amplitude or torque amplitude) derived with the proposed method (e.g., the equations shown and described above). The values are shown for a sensor that is mounted at different distances from the bit in meters within the downhole system as indicated by the horizontal axis. As a comparison, the theoretical amplitudes for a rotational velocity of 100 RPM are shown by lines 404*a*, 404*b*, 404*c*, 404*d*, 404*e*, 404*f* versus the distance-from-bit. The equivalent maximum load value and the maximum of the theoretical maximum amplitudes along the BHA or drill string are nearly similar (e.g., at about 20 m DfB for curve 404*a*, about 8.5 m DfB for curve 404*b*, about 8.5 m DfB for curve 404*c*, about 3 m and 15 m DfB for curve 404*d*, about 5 m and 13 m DfB for curve 404*e*, and about 9 m and 17 m DfB for curve 404*d*). As will be appreciated by those of skill in the art, the mathematical equations of the present disclosure may output a relatively constant, single value for each sensor distance from the bit that is the highest amplitude along the BHA or drill string.

Advantageously, employing embodiments of the present disclosure, the maxima of the calculated load values along the BHA or drill string and the maximum equivalent load values are similar for every sensor position. Thus, as noted above, embodiments provided herein enable vibration estimation and thus enable an operator to adjust a drilling operation to mitigate or minimize downhole vibrations.

Due to the nature of the measurements made in accordance with embodiments of the present disclosure, the amplitude of the measured dynamic torque can be low and the torsional/tangential acceleration amplitude can be very high or vice versa (e.g., as shown in FIGS. 3B-3C, points 302, 304). Further, at one specific location, the maximum/minimum load amplitude over time may be very low whereas the maximum/minimum load along the BHA or drill string can be very high. Using an approach in accordance with the present disclosure, the maximum/minimum information (e.g., maximum/minimum load amplitude over time at one specific location) may be extracted from the measured load over time at one location, such as from the dynamic torque measurement and/or the torsional/tangential acceleration measurement. From the measured load over time at one location, one or more maximum/minimum may be determined using a maximum/minimum detection algorithm. This can be done in the time domain at the measured data values. Alternatively, or in addition, a frequency analysis may done on at least some of the measured data values thereby creating a frequency spectrum of those measured data values. From the frequency spectrum, maximum/minimum may be determined using a peak detection algorithm. Determination of the maximum/minimum from the frequency spectrum may be more accurate than determining the maximum/minimum in the time domain. The maximum/minimum values can be different with respect to the frequency for the dynamic torque and the torsional/tangential acceleration measurement at one location compared to a different location along the BHA or drill string, as discussed. Therefore, it is reasonable to calculate the maximum torsional/tangential acceleration and maximum dynamic torque for frequencies with high amplitudes in either of the spectra (or all frequencies). From the maximum, as proposed by the algorithm presented herein, an informed decision can be made at which frequency the most critical amplitudes occur. The most critical frequencies and corresponding calculated maximum values can then be presented to a field engineer and be compared to a (tool) limit.

In another example, stick/slip has a very low frequency below 1 Hz down to 0.2 Hz or even 0.1 Hz (e.g., corresponding to a time scale of up to 1 s, 5 s, or even 10 s) compared to a typical case of HFTO (typically between 20 Hz and 1000 Hz). Stick/slip may lead to a significant increase in the RPM, for example, stick/slip may result in RPM that may be more than double the average RPM. The amplitudes of the dynamic torque and the torsional/tangential acceleration are low during the stick phase and very high in the slip phase (high RPM values). From theory the worst-case amplitude is linearly scaled by the RPM. Therefore, stick/slip can lead to a significant increase of the worst-case amplitudes of HFTO that can also be found in measurements. The worst-case amplitude only occurs in a small time interval in one period of the stick/slip cycle where the highest RPM is reached. The averaging effect of the Fourier analysis or a so-called Fast Fourier Transformation ("FFT") to extract the frequency information of the amplitudes is well known. That is a FFT would only lead to an average amplitude of torsional/tangential acceleration or dynamic torque with respect to the stick/slip cycle and the interval of the FFT. The peak amplitudes are not detected and represented in the derived frequency spectrum if the time window of the FFT is too long in comparison to the time where the maximum amplitudes (with respect to time) occur. Therefore, the time window of the FFT has to be chosen to capture the maximum HFTO amplitudes during a modulation with stick/slip. The application of tapering functions (e.g., Hanning Window) improves the extraction of frequency information from the analyzed time window of the FFT (sample time interval). Negative boundary effects on the resulting frequency information may be reduced.

Figure 5:
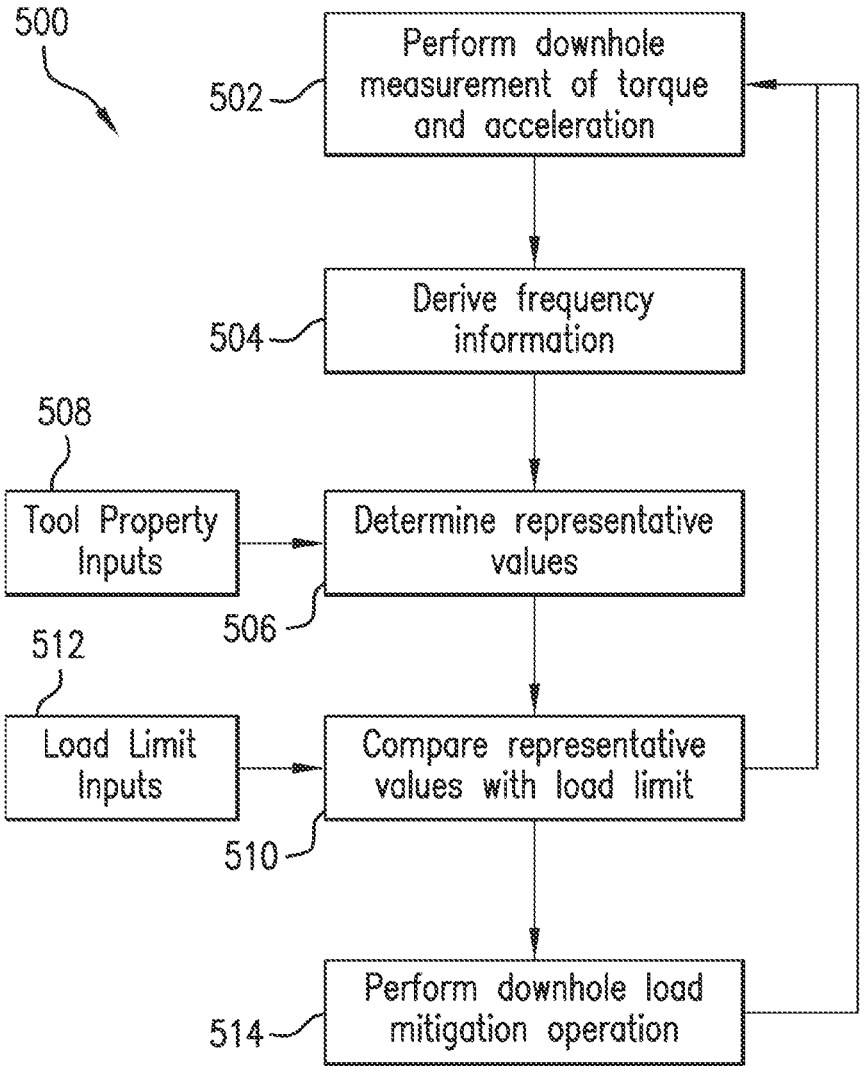
FIG. 5 is a flow process for mitigating downhole loads in accordance with an embodiment of the present disclosure.

Turning now to FIG. 5, a schematic illustration of a flow process 500 in accordance with an embodiment of the present disclosure is shown. The flow process 500 may be performed, in part, for example, using a system similar to that shown in FIG. 1, or variations thereon. Further, the flow process 500 may incorporate aspects of the above described modeling and analytical analysis. Various computations may be performed using one or more processors, located downhole and/or at the surface. Further, one or more sensors may be arranged on a downhole system that may be configured to measure torque and/or acceleration to generate data to be employed in accordance with the above described processes. Advantageously, using the above analytical analysis, the location of the sensors is eliminated as a variable, and thus improved estimation of downhole vibrations and/or loads may be determined. Further, the flow process 500 may be employed to enable mitigation of vibration in a drill string, as described herein.

The output and/or result of the flow process 500 is the potential reduction of vibration and/or loads that exist during drilling operations. For example, one action an operator can take is a reduction in rotary speed to thus reduce the loads at the bit or near bit. Dominant frequencies and amplitude levels of a given system that implements the flow process 500 may be identified by measurements, as will be appreciated by those of skill in the art. A frequency analysis, such as a Fourier analysis (e.g., discrete Fourier transform, fast Fourier transform), may be employed to extract the frequency information of time signals obtained from downhole signals and/or transforms the time-based signal into the frequency domain. For each frequency, maximum/minimum load values (e.g., torque and/or acceleration values) can be determined. Related information may be extracted and transmitted to the operator at the surface, and subsequent action can be taken based on the received information (e.g., the sum of amplitudes of different frequencies). In an alternative embodiment, actions may be taken by an automated process, e.g., by the surface control unit or a downhole control unit.

For example, if levels of a given value are observed that exceed a preset threshold, procedures can be initiated to mitigate vibrations or loads by adjusting the operational parameters such as flow rate, rotary speed at the top drive (alternatively at a kelly drive), hook load, weight-on-bit (WOB), mud property, borehole inclination, etc. Preset thresholds may be based on limits that are defined during tool design or developed from experience, historical data, modeling, etc. The measured values (or observed values) may be compared with the preset thresholds, as described below. Using a feedback loop, the effectiveness of the actions taken can be analyzed using the same flow process 500, thus enabling further action that may mitigate vibrations and/or loads downhole. As used herein, loads can include, but are not limited to, angular acceleration, torsional/tangential acceleration, angular velocity/deflection, and dynamic torque.

At block 502, the one or more downhole sensors collect data associated with torque and/or acceleration of the downhole system (e.g., BHA, drill bit, drill string, etc.). The torque measurement may include dynamic torque and the acceleration measurement may include tangential and/or torsional acceleration. The dynamic torque measurement may be obtained using one or more strain gauges, as will be appreciated by those of skill in the art. In some embodiments having more than one strain gauge, each strain gauge may be located at a different position along the BHA or drill string with a known distance between the strain gauges.

Acceleration measurements are obtained from one or more accelerometers. In some embodiments having more than one accelerometer, each accelerometer may be located at a different position along the BHA or drill string with a known distance between the accelerometers. As will be appreciated by those of skill in the art, vibration can be separated by direction into axial, torsional, and lateral accelerations. It is necessary to distinguish between different accelerations directions because different types of vibrations may require different mitigation strategies. Generally, sensor acceleration signals are a superposition of lateral, torsional/tangential, and axial accelerations. Axial, torsional, and lateral accelerations are typically derived from sensor signals measured at sensor positions.

The acceleration of the rotation angle $\varphi$ is called angular acceleration. The angular acceleration $\ddot{\varphi}=\ddot{\omega}$ and torsional/tangential accelerations $\alpha_T$ are linearly dependent such that $\alpha_T=\ddot{\varphi}r=\dot{\omega}r$. torsional/tangential acceleration is caused by an angular acceleration $\ddot{\varphi}$. The torsional/tangential acceleration is the corresponding translational acceleration (e.g., corresponding translational acceleration of a sensor) in an arc length direction (e.g., a circumference direction). Torsional/tangential accelerations are linearly dependent on a radius r (e.g., radius r where a sensor is placed). Finally, radial accelerations can be calculated by $\alpha_R=\dot{\varphi}^2\ r=\omega^2$ radius r. Similar to the torsional/tangential accelerations, radial accelerations are scaled with a radius r. If the sensor is moving on a circular path it is accelerated to the instantaneous center of rotation of the tool because the sensor is fixed to the tool.

Accordingly, at block 502, a first load measurement and a second load measurement (e.g., dynamic torque and/or acceleration measurements) are made.

At block 504, frequency information may be derived. For example, a Fourier analysis (e.g., Goertzel algorithm, discrete Fourier transform, fast Fourier transform, etc.) may be used to extract the frequency information of time signals of the drilling system (such as amplitude versus frequency).

At block 506, representative values for each of the first load and/or the second load may be determined. The representative value may be a maximum load of the respective load measurement. The determination made at block 506 may have various tool property inputs 508 associated with tool and/or system properties. Thus, the representative values may be dependent, in part, upon the system/tool arrangement, and various inputs associated therewith may enable improved accuracy for determining representative values (e.g., active maximum loads during a drilling operation). For example, tool property inputs 508 may include, but are not limited to, geometry, tool size, material properties, etc.

At block 506, for example, for each frequency, load data, such as an equivalent dynamic torque and an equivalent torsional/tangential acceleration may be obtained as representative value(s). In some embodiments, the most significant values (i.e., maximum) or related information (e.g., vibration levels representing one or more maxima of the load data) may be extracted using downhole processing and subsequently transmitted to the surface to inform an operator of the representative value(s).

At block 510, the representative value(s) is compared with a respective load limit associated with the system. The comparison may be performed downhole or at the surface, as will be appreciated by those of skill in the art. Block 510 may have an input of load limit inputs 512 (e.g., preset threshold values). In some embodiments, the load limit inputs 512 may be derived from the drill string/tool/system design specifications. The load limit inputs 512 define amplitudes of loads that are not to be exceeded, and are typically predefined values associated with the tools and/or systems.

At block 510, the system (or an operator) may compare the measured loads (block 506) with the load limits 512, to determine if current loads within a drilling system exceed the load limits 512.

If, at block 510, the measured loads are below the load limits 512, the process may return to block 502 such that a feedback loop is performed and active or actual loads are continuously monitored during a drilling operation.

However, if at block 510, the measured loads meet or exceed the load limits 512, the process 500 may continue to block 514. At block 514, a downhole load mitigation operation may be performed. The downhole load mitigation operation may include, but is not limited to, adjusting flow rates, adjusting rotary speeds of the drill string, adjusting hook loads, adjusting mud properties, and adjusting weight-on-bit (WOB).

Once the downhole load mitigation operation is performed at block 514, the flow process 500 may return to block 502 in the feedback loop described above. Thus, the results or impact of the downhole load mitigation operation may be determined, and if insufficient to lower the loads below the load limits 512, further downhole load mitigation operations may be performed. Once the active loads are reduced below the load limits 512, the flow process 500 may be looped to monitor downhole loads and indicate if further downhole load mitigation operations should be performed.

In some of the above described embodiments, the load sensors may be assumed to have a synchronization at a high accuracy (e.g., an accuracy rate that is lower than 1/(sampling rate of the load sensors), e.g. 1/(1000 Hz)). The high sampling rate of the load sensors is desired to minimize aliasing of the HFTO. However, such accurate synchronization may be too expensive or may even not be available in a downhole tool or a specific BHA setup as it would require dedicated bus structure and fast and reliable communication downhole. According to some embodiments of the present disclosure, a means or process for calculating a maximum HFTO load in a BHA may be achieved with synchronized load measurements at a high sampling rate where the synchronization of the load measurements is much higher (i.e., worse) than 1/(sampling of the load sensors).

In accordance with embodiments of the present disclosure, at least three independent measurements are taken to measure HFTO. In this context, independent measurements means that the load measurements do not give the same information and the load measurements of one load sensor cannot be derived from the load measurements of the other sensor. An example of dependent load measurements are a rotary speed sensor that measures the angular velocity fluctuation due to HFTO and a torsional/tangential acceleration sensor that can be used to determine the angular acceleration at the same axial location. Because one information can be derived from the other by, for example, calculating the first derivative or integration with respect to time, the measurement of torsional/tangential acceleration and the measurement of rotary speed at the same axial location in the drill string are called "dependent measurements" in the context of this disclosure. In contrast, measurements at different axial locations of the drill string or measurements at the same axial location of the drill string but of different physical quantities that cannot derived from each other are named "independent measurements" within the context of this disclosure. In accordance with some embodiments, at least one independent measurement is taken at a point that has an amplitude of the observed mode (i.e., not at a zero point). The amplitude distribution can be identified by the vibration mode shape. Because the vibration mode shape is assumed to be unknown, requirements for the distance can be defined with respect to the wavelength of the vibration mode shape that correlates to the frequency of HFTO.

In some embodiments, two sensors that may be employed in accordance with an example configuration for independent measurements include a torsional/tangential acceleration measurement and a dynamic torque measurement that are arranged at the same (axial) location along the BHA or drill string. That is, the distance-from-bit is the same for the two sensors. In other embodiments with an example configuration for independent measurements, two load (acceleration and/or torque) sensors may be arranged at locations that are separated by a distance that is smaller than a fraction of a wavelength of the mode shape (e.g., separate distance of smaller than 1/16 wavelength, smaller than 1/8 wavelength, etc.) along the BHA or drill string. In some embodiments, two similar load sensors (i.e., configured to measure the same property, e.g., two acceleration sensors or two torque sensors) that have a separation distance that is smaller than or equal to a fraction of the wavelength of the mode shape may be employed. In some embodiments, a synchronization of the sensors providing independent measurements with a given accuracy (e.g., 5 seconds) may be employed.

In accordance with embodiments of the present disclosure, the physical measurements at different positions are obtained at different specific times. Measurement data values from a certain and predetermined time frame is derived to one or more aggregated values using, for example a frequency analysis to determine one or more amplitudes associated to one or more frequencies, a root mean square value, a maximum or minimum, or an average (e.g., an arithmetic, harmonic, or geometric average, or a median, etc.) or statistical value, or any other means as known in the art. The measurement data values can be stationary over time. That is, the one or more measurement data values remain constant (e.g., within certain or predetermined boundaries) within a certain or predetermined time frame. The independent measurements of the load sensors, for example, the load sensors at different axial locations along the BHA or drill string may be synchronized within that certain and predetermined time frame. For example, the measurement data values, such as the amplitude at all frequencies, could vary below 5% or below 20%. In some cases, such as when there is an interaction of stick/slip and HFTO, the certain and predetermined time frame may be defined with respect to a time period of the stick/slip. The reason is that stick/slip may significantly influence an amplitude of HFTO, with a given HFTO amplitude close to zero in the associated stick phase and a high HFTO amplitude in the slip phase. It can be the case that the driller or user of the information is interested in the maximum amplitude (time wise) that is occurring in the slip phase. The time stamps of measurement that are related to the real time of the physical measurement will then be sufficiently accurate to capture the non-stationary effects of stick/slip. That is, for example, all measurements that are used to derive the one or more aggregated values are taken in the slip phase rather than in the stick phase. When stick/slip occurs, the required synchronization accuracy is dependent upon the period of time of stick/slip and could be, for example, 0.1 seconds or 0.5 seconds or greater. It could be important that the certain and predetermined time frame is associated to the maximum load value during a stick/slip cycle and averaged in a reasonable time frame (e.g., 0.2 or 0.5 seconds) associated to the highest amplitudes during a stick/slip cycle. The one or more aggregated values from the independent measurements of the load sensors within certain and predetermined time frame may be taken and the maximum load value along the BHA or drill string may be derived. The stationary response is valid at all distances from the bit. This synchronization process is not the same as a synchronization with an accuracy in the order of 1/(sampling rate of the load sensors). Because electronic clocks, for example electronic clocks that are coupled to load sensors for timing load sensor measurements, for downhole drilling suffer from the harsh environment including high vibrations and temperature, a synchronization of load sensor measurements with high accuracy (e.g., with an accuracy equal to or better than 10 sampling intervals=1/(sample rate) of the downhole load sensor or even with an accuracy equal to or better than 1 sampling interval=1/(sample rate) of the downhole load sensor) is a difficult to achieve requirement resulting in expensive equipment. A synchronization with lower accuracy requirement, such as described above, is much easier to achieve leading to more cost-efficient equipment.

Figure 6A:
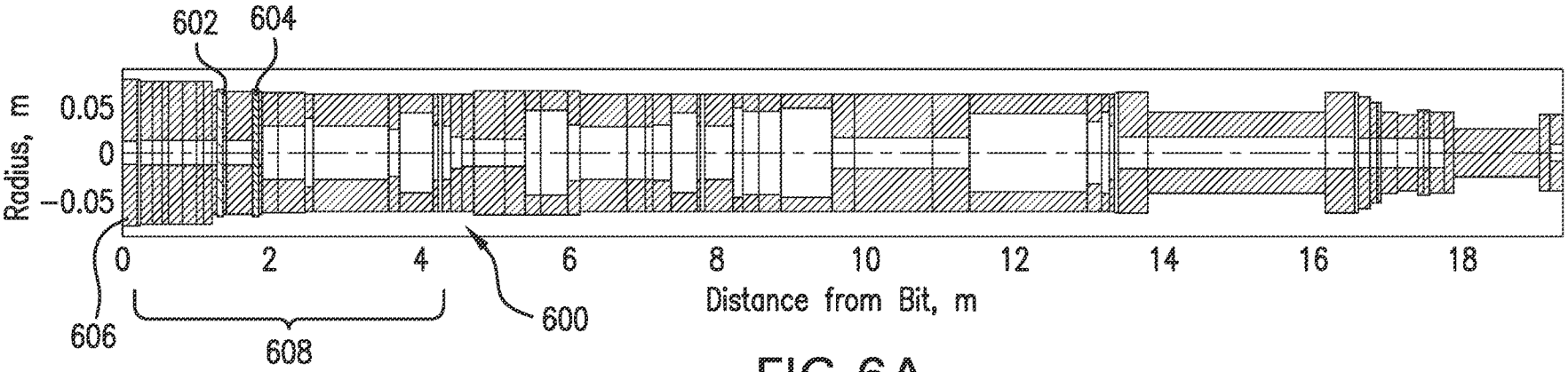
FIG. 6A is a schematic illustration of a downhole tool having a sensor arrangement in accordance with an embodiment of the present disclosure.
Figure 6B:
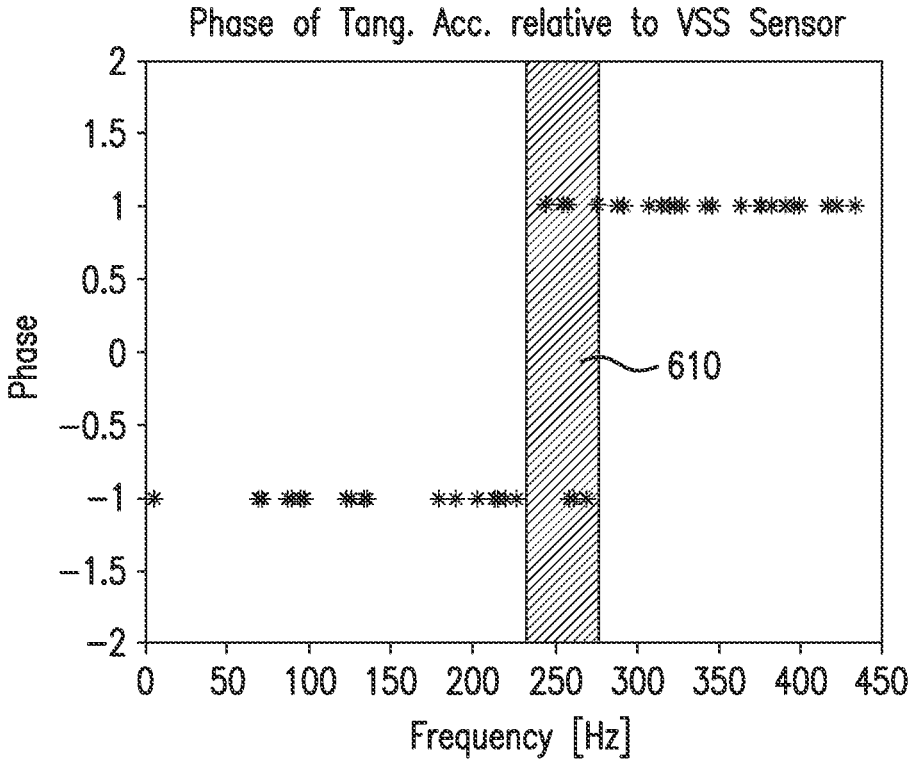
FIG. 6B is a schematic plot of frequency and phase illustrating that the phase between two measurements may be frequency dependent.
Figure 6C:
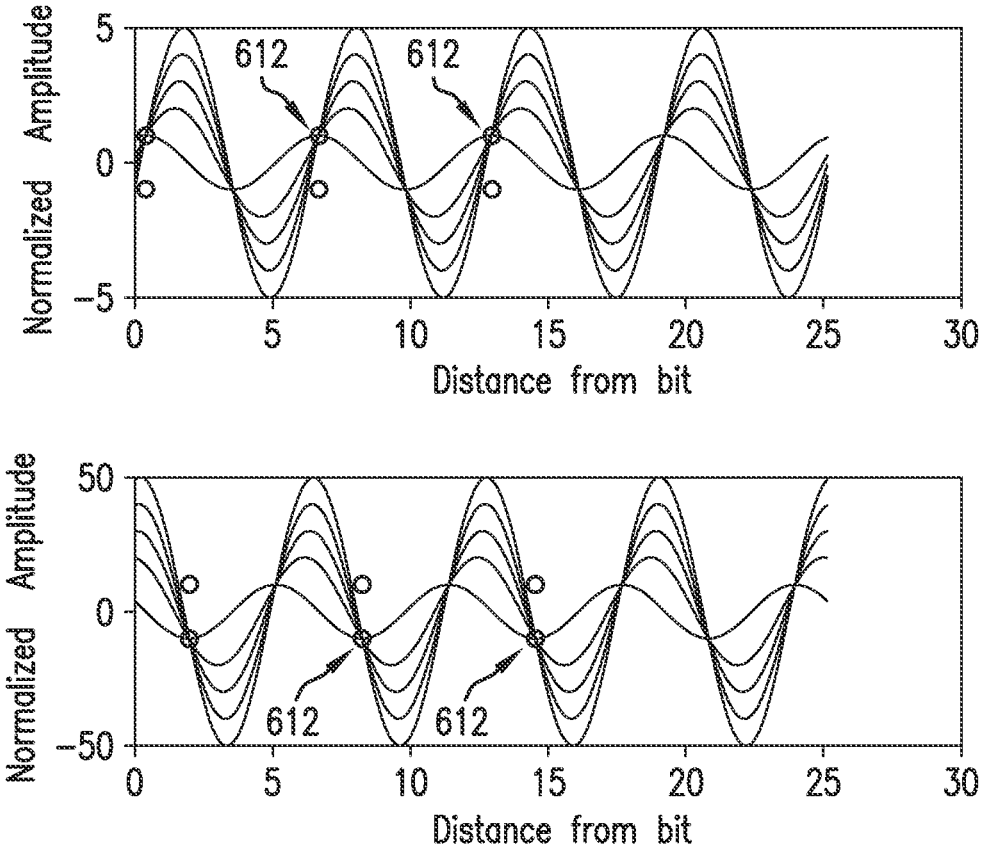
FIG. 6C illustrates normalized amplitude as a function of distance from a drill bit, illustrating redundancy of information in signals.

Turning now to FIGS. 6A-6C, an embodiment in accordance with the present disclosure is illustrated. In this case, two independent measurements to apply the analytical approach described above and calculate the maximum loads along the BHA or drill string are employed. If the sensors are synchronized with an accuracy significantly lower than the sampling intervals of the utilized load sensors (e.g., lower than all the sampling intervals of the utilized load sensors, or lower than 10 times of all sampling intervals of the utilized sensors), in this case, two sensors are sufficient. In some embodiments, one load sensor may be arranged on a first downhole tool and the second sensor may be arranged on a separate/different downhole tool, wherein the first downhole tool and the separate/different downhole tool are threadedly connected together by threads about the inner bore of the drill string. In such arrangements, it may be impossible to provide uninterrupted wires or other electrical conduits of conducting materials between electronic boards that are connected to the first and second load sensors and their respective associated clocks, which makes it more difficult or even impossible to achieve a synchronization with low accuracy (e.g., lower than 10 times of all sampling intervals of the utilized sensors or even lower than all sampling intervals of the utilized load sensors) between the load sensors and/or their associated clocks. In some embodiments, one or more sensors can be replaced by additional information or systematic information from modeling or data analysis.

For example, boundary conditions may be employed to eliminate one of the three sensors. The dynamic torque at the bit is zero. This information could be used, but, because the drive shaft is not homogeneous such information may not be a practical approach (e.g., the math may not be applicable to such a system/sensor configuration). However, systematic knowledge of the nodes of torsional/tangential acceleration (and proportional measurements like rotary speed or angular acceleration) or dynamic torque dependent on parameters like the excited frequency can be used if the tools that are used are always at a similar position compared to the bit. A tool that is always at a similar position compared to the bit could for example be a steering unit that is always placed at the beginning of the BHA behind the bit. For example, as shown in FIG. 6A, a downhole tool 600 including a steering unit 608 relatively close to drill bit 606 (e.g., adjacent to drill bit 606) includes a first load sensor 602 and a second load sensor 604 arranged on the steering unit 608 and proximate the drill bit 606.

From the information of the node position of the excited vibration mode shape relative to each other, the phase is known. This additional information reduces the needed number of sensors to two with a synchronization accuracy significantly lower than the corresponding sampling intervals of the two load sensors as discussed above. One example is shown in FIGS. 6A-6B. In this example, load sensor 602 is a torque sensor and load sensor 604 is an acceleration sensor in a steering unit 608 that is arranged adjacent or close to the bit 606. FIG. 6B illustrates the relationship between mode frequency (horizontal axis) and associated phase difference between measurements from load sensor 602 and measurements from load sensor 604 (vertical axis) for a number of excited modes. There is a frequency band 610 where the phase is switching from −1 to +1, which means that at least one of load sensor 602 and load sensor 604 is in a node of the modes with frequencies in the frequency band 610 and the associated sensed amplitudes are relatively low (e.g. more or less close to zero). FIG. 6B shows an example where the phase between two measurements is dependent on the frequency and can be used as additional information to eliminate one of three sensors required.

If the assumption of the homogeneous system is applied, there are distances of the first, second, and third sensors at which of the system is less performant. For example, in case of two acceleration sensors (or any mixture of rotary speed or acceleration based sensing), the distances $\Delta x$ between these sensors that should be avoided are those where $$\kappa\Delta x = \frac{\pi i}{L}\Delta x$$

equals multiples of $\pi$. As can be seen in FIG. 6C, multiple curves fit through sensors 612 with the same amplitude at this distance because the information is redundant. The same applies for two torque sensors. For mixed sensing, such as torque sensing and acceleration sensing, the distance that is needed to be avoided is $\kappa\Delta x$ equals $\pi/2$ and multiples of $\pi$. As described above, K as well as the wavelength along the BHA or drill string, is a function of the frequency and the material properties. The expected frequencies in a particular application can be calculated by state of the art modeling (e.g., finite element modeling) and is related to the sensor distance that should be avoided. The expected modes can be ranked by their susceptibility. The sensor distance can be chosen to avoid certain distances or this information can be chosen to identify frequencies where the algorithm is less performant and assumptions may be beneficial. For example, assumptions may be that a highest measured load in the BHA is measured or linked to the rotary speed. It is known that HFTO is highest at the bit in the majority of cases. Hence, with the average rotary speed a reliable upper limit of maximum load amplitude along the BHA or drill string can be calculated. This upper limit may then be used as an additional information to sort out load amplitudes that are above this upper limit.

Figure 7:
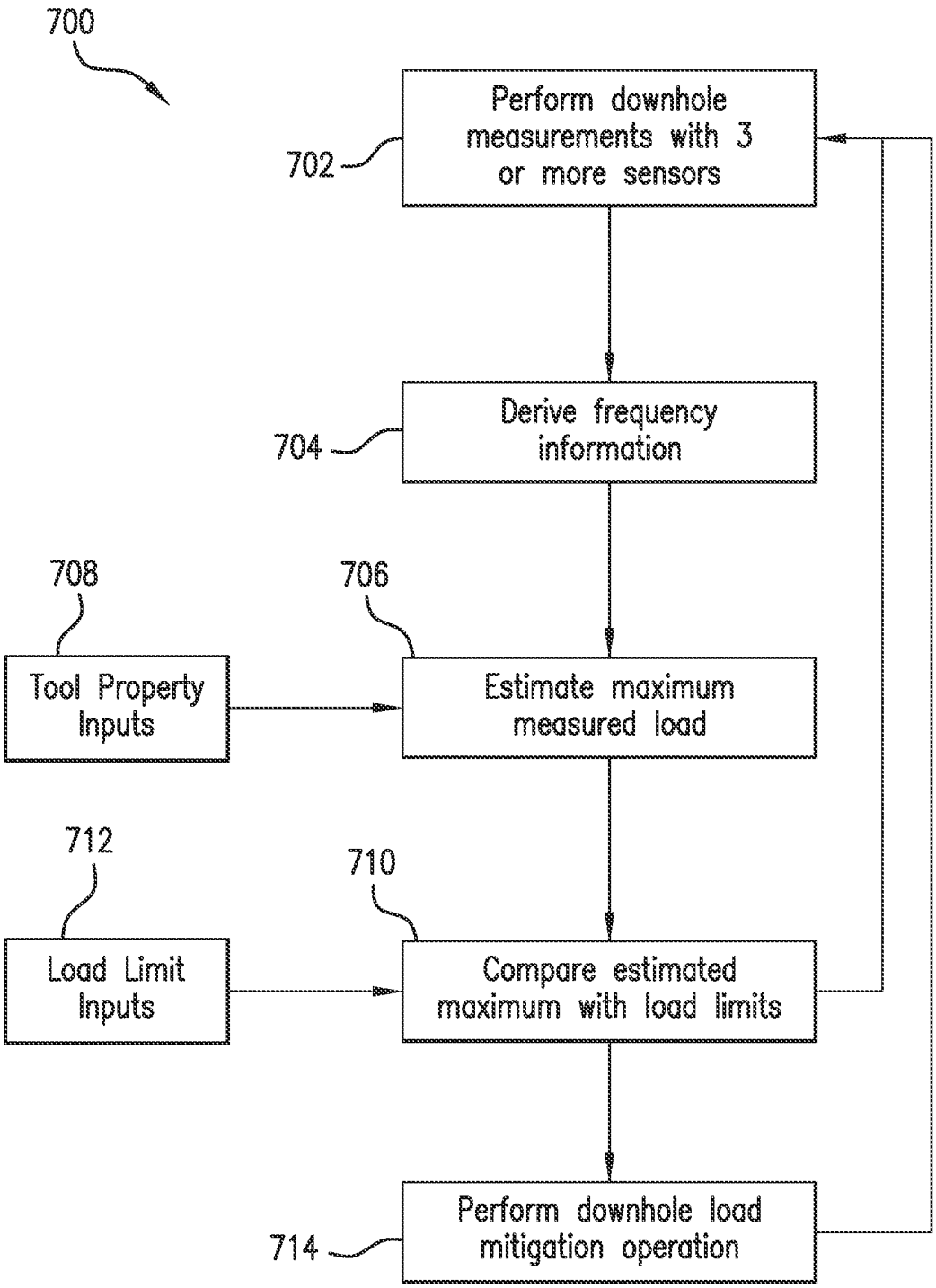
FIG. 7 is a flow process for mitigating downhole loads in accordance with an embodiment of the present disclosure.

Turning now to FIG. 7, a schematic illustration of a flow process 700 in accordance with an embodiment of the present disclosure is shown. The flow process 700 may be performed, in part, for example, using a system similar to that shown in FIG. 1, or variations thereon. Further, the flow process 700 may incorporate aspects of the above described modeling and analytical analysis. Various computations may be performed using one or more processors, located downhole and/or at the surface. Further, one or more sensors may be arranged on a downhole system that may be configured to measure torque, tangential or torsional acceleration, and/or rotary speed to generate data to be employed in accordance with the processes described herein. Advantageously, using the analytical analysis described herein, and employing three or more sensors, the system will perform without the need for high accuracy synchronization. This can result in improved estimation of downhole vibrations and/or loads and more cost efficient mitigation of damaging effects vibration effects. The reduced requirements with respect to synchronization can enable the derivation of the maximum loads with sensors within different tools that are typically not synchronized with an accuracy of the sensor's sampling rate, thus reducing the costs associated therewith. In operation, three or more measurements and frequency content are derived. In some embodiments, a least square method or a similar method (e.g., Pseudoinverse, interactive methods, etc.) can be employed to estimate the maximum of the vibration mode shapes. From the maximum of the vibration mode shape estimated in this way and/or the amplitudes associated with the vibration mode shape and the corresponding natural frequency, the maximum load in the BHA associated to the vibration mode shape within a certain part of the BHA can be derived that can be assumed to be homogeneous with respect to the torsional mass distribution and stiffness distribution. Further, the flow process 700 may be employed to enable mitigation of vibration in a drill string, as described herein, such as performing responsive actions or controls of the drilling operation.

The downhole tool can include multiple sensors, with the sensors arranged at axial positions along a BHA or drill string. For example, at least some of the multiple sensors may be arranged at substantially the same axial location along the BHA or drill string. For example, the at least some of the multiple sensors may be arranged at the same distance-from-bit. Accordingly, during a rotation of the tool, those sensors are arranged to measure properties or aspects of the rotation and vibrations of the tool during use, at the same (or substantially same) location. In other embodiments, some or all of the multiple sensors may be arranged at different axial positions along the BHA or drill string. The sensors are configured to measure, monitor, or collect data associated with multiple, independent properties of the operation of the downhole system. For example, when one property can be derived from the other by, for example, calculating the first derivative of the rotary speed with respect to time, the measurement of torsional/tangential acceleration and the measurement of rotary speed at the same axial location in the drill string are called "dependent measurements" in the context of this disclosure; in contrast, properties, such as different physical quantities, that cannot derived from each other are named "independent measurements" within the context of this disclosure. It will be appreciated that although the sensors are configured to monitor independent properties, each of the measured or monitored properties are related to measuring HFTO (e.g., rotational speed, acceleration, torque, etc.).

At block 702, three or more downhole sensors are operated or configured to collect data associated with torque, acceleration, and/or rotary speed of the downhole and/or drilling system (e.g., BHA, drill bit, drill string, etc.). As such, a first load measurement, a second load measurement, and a third load measurement may be obtained using respective load sensors. The torque measurement may include dynamic torque and the acceleration measurement may include tangential and/or torsional acceleration. The dynamic torque measurement may be obtained using one or more strain gauges, as will be appreciated by those of skill in the art. In accordance with embodiments of the present disclosure, rotary speed can be measured by radial acceleration or by sensing that is configured to capture the gravity in a lateral acceleration sensing. The amount of acceleration sensors should be high enough (e.g., four sensors) to distinguish between the different kinds of accelerations (e.g., axial, torsional/tangential, lateral x, and lateral y vibration, where x and y denote two directions perpendicular to each other and perpendicular to the longitudinal axis of the downhole tool). The rotary speed can also be measured as a bending that is present in the BHA. The rotary speed is typically measured by one or more magnetometers that measure a relative rotation of the drilling system with respect to the magnetic field of the earth. In some embodiments, the rotary speed may be calculated from bending or radial acceleration in the casing where the magnetic field is noisy due to a ferromagnetic casing or in a similar situation where ferromagnetic or magnetic parts/components are nearby.

Acceleration can be measured by different principles, such as by piezoelectric or magnetorestrictive sensing. Typically, it is advantageous to distinguish between different directions of acceleration (e.g., lateral x/y, axial, torsional/tangential and radial). For this purpose, a number of sensing devices at one axial position may be required that are sufficient to separate these different directions/vibrations. The different sensing devices could be at one sensing in an axial direction or two accelerometers that are arranged directly opposite to each other with respect to the tool axis in the torsional/tangential direction. In some embodiments, four measurements in a plane of one axial position can be used and the sensing devices may be arranged collocated or in another way that the measurements are not redundant or mathematically linear dependent.

In accordance with embodiments of the present disclosure, a similar concept may be used for strain measurements. Different strain measurements can be used at a similar distance-from-bit to separate between a bending strain, a weight strain corresponding to an axial force, and a torque strain. Accordingly, at block 702, dynamic torque, acceleration, and rotary speed measurement(s) are made and resulting from the logics and algorithms applied to separate between different sensing at a single axial position.

At block 704, frequency information may be derived. For example, a Fourier analysis (e.g., Goertzel algorithm, discrete Fourier transform, fast Fourier transform, Fourier analysis, etc.) may be used to extract the frequency information of time signals of the drilling system (such as amplitude versus frequency). In the process 700, the frequency information derived at block 704 may be obtained over a specific time frame. For example, in accordance with an example embodiment, each of the sensors associated with process 700 (e.g., three or more sensors) may obtain information over a 0.5 second period or window. This time window allows for identification of all transient effects, such as transient effects related to the interaction of HFTO and stick/slip with the drill string. At block 704, the minimum requirement is to perform the derivative operation of frequency upon a single or one of the three or more measurements. However, to improve accuracy and/or reliability, the derivation of frequency may be performed with multiple (e.g., two or more, or even all) of the datasets and information obtained at block 702. In accordance with some embodiments, if only one frequency information is obtained and one frequency is dominant in this measurement, the other measurements and calculated amplitudes may be assumed to have predominantly also only one frequency in the measurement. This is often the case in HFTO and may reduce the computational effort associated to each sensing. The frequency information may be, in some embodiments, frequency and amplitude information associated to a particular frequency. In some embodiments, the frequency information may be a kind of characteristic curve that is related to the wavelength at the identified frequency. For example, such curve may be a line (e.g., linear) in the case of a homogeneous structure.

At block 706, an estimation of a maximum measured load amplitude maybe performed using analytic processing (e.g., analytical equations) based on the frequency information from block 704. The determination made at block 706 may also have various tool property inputs from block 708 associated with the tool and/or system properties (e.g., material properties, geometry properties, and aggregates thereof). It will be appreciated that the wavelength will be a function of these tool and/or system properties. Thus, the maximum measured load amplitude values may be dependent, in part, upon the system/tool arrangement, and various inputs associated therewith may enable improved accuracy for determining representative values (e.g., active maximum loads during a drilling operation). For example, tool property inputs from block 708 may include, but are not limited to, geometry, tool size, material properties, etc.

For example, at block 706, three or more amplitudes at different sensor positions are taken at a specific time and frequency, separated by a frequency analysis, as described above. In some embodiments, a single frequency analysis may be sufficient, and the same frequency can then be assumed at other locations. Alternatively, in some embodiments, the frequency information from one axial location may be used to reduce the computational effort at another location.

The same assumption is applied that the drilling system or BHA is more or less homogeneous and has a uniform material (e.g., steel with a certain constant density and Young's modulus along the BHA or drill string). The frequency measured and the geometry and material properties assumed for the homogeneous part of the drilling system relate to a certain wavelength of the vibration mode shape that is associated to the torsional mode that corresponds to this frequency. This relationship is distinct. So far, the frequency leads to a wavelength that is related to a sine or cosine (e.g., in the case of a homogeneous torsional structure). The relative position of this sine or cosine to the measurement is not known at this point. Therefore, the sine wave with respect to the axial position is placed in a way that the amplitudes measured at this frequency and the amplitudes that are corresponding to the sine or cosine wave have a best-fit match. This best-fit can be achieved by applying a least square or similar approach resulting in the amplitude associated to the analytical vibration mode shape and associated frequency and the relative placement of the vibration mode shape within the BHA or drilling system. Given this information, the maximum of the torsional dynamic torque and the torsional/tangential acceleration (or angular acceleration or a similar derived value) can be estimated.

The above process may be performed for each frequency that occurs in a frequency analysis associated with the at least three measurements positions. The three measurement positions may include two positions on a first downhole tool and a third position being on a second (different) downhole tool. The amplitudes corresponding to the frequency may be separated, respectively. A maximum torque and torsional/tangential acceleration may then be calculated for each frequency and mode along with relative amplitude information estimated by the vibration mode shape that can be used to derive an estimation of component-specific loads at different positions along the BHA or drill string. Given the maximum derived values associated to HFTO or a similar axial vibration phenomenon, ratios can be derived from these amplitudes (e.g., a maximum amplitude related to all amplitudes associated to the next five or ten highest amplitude values associated to frequencies). This information can then be used to distinguish between different formations by a so-called localization value that can be a distinguisher between a formation A that is prone to HFTO and a formation B that is not prone to HFTO.

At block 706, for example, for each frequency, load data, such as an equivalent dynamic torque, an equivalent torsional/tangential acceleration, and/or a rotary speed may be obtained as representative value(s) similar to that described above with respect to process 500 of FIG. 5. In some embodiments, the most significant values (i.e., maximum) or related information (e.g., vibration levels representing one or more maxima of the load data) may be extracted using downhole processing and may be subsequently transmitted to the surface to inform an operator of the representative value(s) and/or maximum values. In accordance with some embodiments, the derived values can be 1-bit (HFTO or no HFTO) values that only require a small telemetry bandwidth and can therefore be sent to the surface by mud pulse telemetry. Further, such telemetry transmission may occur at a relatively high frequency of data transmission. The values may also be associated to a localization ratio or to a limit amplitude to distinguish HFTO or no HFTO. This 1-bit value could also be a distinguisher between two different formations that are prone to HFTO or not prone to HFTO.

At block 710, the representative value(s) (e.g., estimated maximum load value(s)) from block 706 may be compared with one or more respective load limits associated with the system. The comparison may be performed downhole or at the surface, as will be appreciated by those of skill in the art. Block 710 may have an input of load limit inputs 712 (e.g., preset threshold values). In some embodiments, the load limit inputs 712 may be derived from the drill string/tool/system design specifications. The load limit inputs 712 define amplitudes of loads that are not to be exceeded and are typically predefined values associated with the tools and/or systems. At block 710, the system (or an operator) may compare the measured loads (block 706) with the load limits 712, to determine if current loads within an operational drilling system exceed the load limits 712.

If, at block 710, the measured loads (block 706) are below the load limits (block 712), the process 700 may return to block 702 such that a feedback loop is performed, and active or actual loads are continuously monitored during a drilling operation.

However, if at block 710, the measured loads (block 706) meet or exceed the load limits (block 712), the process 700 continues to block 714. At block 714, a downhole load mitigation operation is performed. The downhole load mitigation operation (block 714) may include, but is not limited to, adjusting flow rates, adjusting rotary speeds of the drill string, adjusting hook loads, adjusting mud properties, and adjusting weight-on-bit (WOB). Once the downhole load mitigation operation (block 714) is performed, the flow process 700 may return to block 702 in the feedback loop described above. Thus, the results or impact of the downhole load mitigation operation may be determined, and, if the mitigation is insufficient to lower the loads below the load limits (block 712 as compared at block 710), further downhole load mitigation operations may be performed. Once the active loads are reduced below the load limits (determined at block 712), the flow process 700 may be looped to monitor downhole loads and indicate if further downhole load mitigation operations should be performed.

An example of a downhole system having three sensors to enable flow process 700 may include three (or more) HFTO-related measurement sensors. For example, a first sensor may be a vibration and stick/slip measurement sensor in a steering unit that is a rotary steerable system that is able to steer the system relative to a formation along a predefined well path or relative to a gas, water, or oil contact that is known to be optimal for carbonate production from the well. A second sensor may be a vibration and stick/slip measurement sensor in a directional tool of the system, and a third may be a load sensor in the SU, which may obtain dynamic torque. From each of these sensors, frequency analysis algorithms may be applied to extract information to determine maximum HFTO loads, as described above. Upon determination of such maximum loads and determination if current loads exceed the maximum loads, mitigation actions may be performed to reduce, minimize, and/or eliminate vibrations that may be considered detrimental to the downhole tool(s).

Advantageously, embodiments described herein enable calculation of representative values (e.g., maximum loads) without the need of synchronization accuracies in the range of associated vibration or load sensors sample intervals to determine the vibration modes (e.g., HFTO modes). In accordance with some embodiments of the present disclosure, a portion of the drill string (e.g., the BHA above the bit or steering unit and below the drill pipes) is assumed to be a nearly homogeneous geometry, allowing to calculate the possible oscillation modes and respective amplitudes analytically. In some embodiments of the present disclosure, the analytical calculation may be transferred into a respective numeric calculation. Using the measurement data of three load sensors measuring three different load parameters provides frequency data and amplitude data of the respective load parameter (e.g., acceleration and torque). The load sensors may be arranged at the same axial location along a BHA or drill string, or within a predetermined maximum distance (e.g., within a fraction of a wavelength). Identifying dominant frequencies (natural frequency) and using the frequency information of the three (or more) load parameters at the same dominant frequency provides a representative load amplitude of the load parameter(s) at the dominant frequency.

In some embodiments, as discussed above, two of the three load sensors may be located at the same location if they are associated to different or independent measurements (or close to each other) along the BHA or drill string. As will be appreciated by those of skill in the art, the terms "same location," "same axial location," "same axial distance from bit" is inclusive of some amount of distance that may be required for manufacturability reasons. As such, these expressions include distances of us to 30 cm, up to 40 cm, or even up to 50 cm. However, as also discussed above, methods for deriving representative load amplitudes with a sensor separation distance $\Delta x$ that is greater than those close distances are also provided (e.g., distance within an HFTO wavelength). Further, embodiments described herein are valid for multiple load sensors measuring the same load parameter (e.g., accelerometers or strain gauges). In such cases, the distance between the two sensors along the BHA or drill string is not close (i.e., not within the close distance mentioned above). It should be mentioned that it is beneficial to adapt the assumed homogeneous structure of the BHA used for calculation for a portion of the BHA, when in this portion the assumed geometry and/or material properties change, meaning the assumed geometrical parameters and/or the material properties are adapted in the homogeneous model to ensure that the analytical equations and the least square algorithm described above deliver the correct results.

Advantageously, embodiments provided herein provide for monitoring downhole loads (e.g., acceleration, torque, vibrations, etc.) without requiring synchronized measurements. Such synchronization is typically at high bandwidth and sampling rate. However, advantageously, embodiments provided herein are directed to a means or process for calculating a maximum HFTO load in a BHA may be achieved with synchronized measurements that are synchronized with an accuracy that is longer than the sampling interval of the corresponding sensors. Based on this information, vibration mitigation actions may be taken. Thus, improved drilling operation efficiencies may be achieved. Further, it will be appreciated that various embodiments described herein, and variations thereon, can be used for various types of vibrations, including, but not limited to lateral vibrations, axial vibrations, HFTO, etc. Advantageously, in accordance with some embodiments, vibrational loads can be derived even when such measurements are not synchronized at high bandwidth and/or high rates. Advantageously, embodiments provided herein can be used to reduce non-productive time because misinterpretation of sensors signals is reduced.

Embodiment 1: A method for mitigating vibration in a drill string, the method comprising: performing a drilling operation using a disintegrating tool; obtaining a first load measurement of a first load during the drilling operation using a first load sensor having a first sampling rate in the drill string; obtaining a second load measurement of a second load during the drilling operation using a second load sensor having a second sampling rate in the drill string, wherein the second load measurement is different from the first load measurement, and wherein the first load measurement and the second load measurement are synchronized with an accuracy that is greater than a first sampling interval corresponding to the first sampling rate and a second sampling interval corresponding to the second sampling rate; and performing a vibration mitigation operation in response to the first measurement and the second measurement.

Embodiment 2: The method of the preceding embodiment, further comprising: obtaining a third load measurement during the drilling operation using a third load sensor having a third sampling rate in the drill string, wherein the third load measurement and at least one of the first load measurement and the second load measurement are synchronized with an accuracy that is greater than the first sampling interval, the second sampling interval, and a third sampling interval corresponding to the third sampling rate.

Embodiment 3: The method of the preceding embodiment, wherein the first load sensor is arranged at a first axial position along the drill string and the second sensor is arranged at a second axial position along the drill string, wherein the first axial position and the second axial position are at a distance of 50 cm or less, and wherein the third sensor is arranged at a distance along the drill string from the first sensor that is less than one wavelength of a HFTO mode of the drill string.

Embodiment 4: The method of the preceding embodiment, wherein the first load sensor and the second load sensor are arranged on a first downhole tool having a first inner bore and the third load sensor is arranged on a second downhole tool that is different from the first downhole tool and having a second inner bore, wherein the first downhole tool and the second downhole tool are connected by threads about at least one of the first inner bore and the second inner bore.

Embodiment 5: The method of the preceding embodiment, wherein the accuracy is 0.1 seconds or greater.

Embodiment 6: The method of the preceding embodiment, wherein the first load sensor and the second sensor, are arranged at locations along the drill string that are at a distance along the drill string less than one wavelength of a HFTO mode of the drill string.

Embodiment 7: The method of the preceding embodiment, wherein the first load sensor is configured to measure at least one of an acceleration, an angular acceleration, a rotary speed, a tangential speed, and a rotary speed, and the second sensor is configured to measure torque.

Embodiment 8: The method of the preceding embodiment, further comprising determining, with a processor in the drill string, a maximum of a HFTO amplitude along the drill string and transmitting the determined maximum of the HFTO amplitude along the drill string from the drill string to the earth's surface.

Embodiment 9: The method of the preceding embodiment, further comprising comparing the determined maximum of the HFTO amplitude along the drill string against a load amplitude limit, wherein the load amplitude limit is determined by using at least one of a numerical simulation of the drill string, historical data, and drill string specification.

Embodiment 10: The method of the preceding embodiment, wherein determining the determined maximum of the HFTO amplitude along the drill string comprises using an analytical model, the analytical model using at least one drill string diameter and at least one drill string material property.

Embodiment 11: A system for mitigating vibration of a drill string, the system comprising: a drilling tool on the drill string and arranged to perform a drilling operation; a first load sensor arranged on the drill string and configured to obtain a first load measurement of a first load during the drilling operation, wherein the first load sensor has a first sampling rate; a second load sensor arranged on the drill string and configured to obtain a second load measurement of a second load during the drilling operation, wherein the second load sensor has a second sampling rate, wherein the second load measurement is different from the first load measurement, and wherein the first load measurement and the second load measurement are synchronized with an accuracy that is greater than a first sampling interval corresponding to the first sampling rate and a second sampling interval corresponding to the second sampling rate; and a processor operably connected to the first, second, and third load sensors and configured to perform a vibration mitigation operation in response to the first measurement and the second measurement.

Embodiment 12: The system of the preceding embodiment, further comprising: a third load sensor arranged on the drill string and configured to obtain a third load measurement during of a third load, the third load sensor having a third sampling rate, wherein the third load measurement and at least one of the first and second load measurement are synchronized with an accuracy that is greater than the first sampling interval, the second sampling interval, and a third sampling interval corresponding to the third sampling rate.

Embodiment 13: The system of the preceding embodiment, wherein the first load sensor is arranged at a first axial position along the drill string and the second sensor is arranged at a second axial position along the drill string, wherein the first axial position and the second axial position are at a distance of 50 cm or less, and wherein the third sensor is arranged at a distance along the drill string from the first sensor that is less than one wavelength of a HFTO mode of the drill string.

Embodiment 14: The system of the preceding embodiment, wherein the first load sensor and the second load sensor are arranged on a first downhole tool having a first inner bore and the third load sensor is arranged on a second downhole tool that is different from the first downhole tool and having a second inner bore, wherein the first downhole tool and the second downhole tool are connected by threads about at least one of the first inner bore and the second inner bore.

Embodiment 15: The system of the preceding embodiment, wherein the first load sensor and the load second sensor are arranged at locations along the drill string that are at a distance along the drill string less than one wavelength of a HFTO mode of the drill string.

Embodiment 16: The system of the preceding embodiment, wherein the accuracy is 0.1 seconds or greater.

Embodiment 17: The system of the preceding embodiment, wherein the first load sensor is configured to measure at least one of an acceleration, an angular acceleration, a rotary speed, a tangential speed, and a rotary speed, and the second sensor is configured to measure torque.

Embodiment 18: The system of the preceding embodiment, wherein the processor is configured to determine a maximum of a HFTO amplitude along the drill string and transmit the determined maximum of the HFTO amplitude along the drill string from the drill string to the earth's surface.

Embodiment 19: The system of the preceding embodiment, wherein the processor is configured to compare the determined maximum of the HFTO amplitude along the drill string against a load amplitude limit, wherein the load amplitude limit is determined by using at least one of a numerical simulation of the drill string, historical data, and drill string specification.

Embodiment 20: The system of the preceding embodiment, wherein determining the determined maximum of the HFTO amplitude along the drill string comprises the processor using an analytical model, the analytical model using at least one drill string diameter and at least one drill string material property.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" or "substantially" used in connection with a quantity is inclusive of the stated value and has the meaning dictated by the context (e.g., it includes the degree of error associated with measurement of the particular quantity). For example, the phrase "substantially constant" is inclusive of minor deviations with respect to a fixed value or direction, as will be readily appreciated by those of skill in the art.

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method for mitigating vibration in a drill string, the method comprising:

performing a drilling operation using a disintegrating tool;

obtaining a first load measurement of a first load during the drilling operation using a first load sensor having a first sampling rate in the drill string;

obtaining a second load measurement of a second load during the drilling operation using a second load sensor having a second sampling rate in the drill string, wherein the second load measurement is different from the first load measurement, and wherein the first load measurement and the second load measurement are synchronized with an accuracy that is greater than a first sampling interval corresponding to the first sampling rate and a second sampling interval corresponding to the second sampling rate; and performing a vibration mitigation operation in response to the first load measurement and the second load measurement.

2. The method of claim 1, further comprising:

obtaining a third load measurement during the drilling operation using a third load sensor having a third sampling rate in the drill string, wherein the third load measurement and at least one of the first load measurement and the second load measurement are synchronized with an accuracy that is greater than the first sampling interval, the second sampling interval, and a third sampling interval corresponding to the third sampling rate.

3. The method of claim 2, wherein the first load sensor is arranged at a first axial position along the drill string and the second load sensor is arranged at a second axial position along the drill string, wherein the first axial position and the second axial position are at a distance of 50 cm or less, and wherein the third load sensor is arranged at a distance along the drill string from the first load sensor that is less than one wavelength of a high frequency torsional oscillation ("HFTO") mode of the drill string.

4. The method of claim 2, wherein the first load sensor and the second load sensor are arranged on a first downhole tool having a first inner bore and the third load sensor is arranged on a second downhole tool that is different from the first downhole tool and having a second inner bore, wherein the first downhole tool and the second downhole tool are connected by threads about at least one of the first inner bore and the second inner bore.

5. The method of claim 1, wherein the accuracy is 0.1 seconds or greater.

6. The method of claim 1, wherein the first load sensor and the second load sensor are arranged at locations along the drill string that are at a distance along the drill string less than one wavelength of a high frequency torsional oscillation ("HFTO") mode of the drill string.

7. The method of claim 1, wherein the first load sensor is configured to measure at least one of an acceleration, an angular acceleration, a tangential speed, and a rotary speed, and the second load sensor is configured to measure torque.

8. The method of claim 1, further comprising determining, with a processor in the drill string, a maximum of a high frequency torsional oscillation ("HFTO") amplitude along the drill string and transmitting the determined maximum of the HFTO amplitude along the drill string from the drill string to the earth's surface.

9. The method of claim 8, further comprising comparing the determined maximum of the HFTO amplitude along the drill string against a load amplitude limit, wherein the load amplitude limit is determined by using at least one of a numerical simulation of the drill string, historical data, and a drill string specification.

10. The method of claim 8, wherein determining the determined maximum of the HFTO amplitude along the drill string comprises using an analytical model, the analytical model using at least one drill string diameter and at least one drill string material property.

11. A system for mitigating vibration of a drill string, the system comprising:

a drilling tool on the drill string and arranged to perform a drilling operation;

a first load sensor arranged on the drill string and configured to obtain a first load measurement of a first load during the drilling operation, wherein the first load sensor has a first sampling rate;

a second load sensor arranged on the drill string and configured to obtain a second load measurement of a second load during the drilling operation, wherein the second load sensor has a second sampling rate, wherein the second load measurement is different from the first load measurement, and wherein the first load measurement and the second load measurement are synchronized with an accuracy that is greater than a first sampling interval corresponding to the first sampling rate and a second sampling interval corresponding to the second sampling rate; and a processor operably connected to the first and second, and third load sensors and configured to perform a vibration mitigation operation in response to the first load measurement and the second load measurement.

12. The system of claim 11, further comprising:

a third load sensor arranged on the drill string and configured to obtain a third load measurement during of a third load, the third load sensor having a third sampling rate, wherein the third load measurement and at least one of the first and second load measurement are synchronized with an accuracy that is greater than the first sampling interval, the second sampling interval, and a third sampling interval corresponding to the third sampling rate.

13. The system of claim 12, wherein the first load sensor is arranged at a first axial position along the drill string and the second load sensor is arranged at a second axial position along the drill string, wherein the first axial position and the second axial position are at a distance of 50 cm or less, and wherein the third load sensor is arranged at a distance along the drill string from the first load sensor that is less than one wavelength of a high frequency torsional oscillation ("HFTO") mode of the drill string.

14. The system of claim 12, wherein the first load sensor and the second load sensor are arranged on a first downhole tool having a first inner bore and the third load sensor is arranged on a second downhole tool that is different from the first downhole tool and having a second inner bore, wherein the first downhole tool and the second downhole tool are connected by threads about at least one of the first inner bore and the second inner bore.

15. The system of claim 11, wherein the first load sensor and the second load sensor are arranged at locations along the drill string that are at a distance along the drill string less than one wavelength of a high frequency torsional oscillation ("HFTO") mode of the drill string.

16. The system of claim 11, wherein the accuracy is 0.1 seconds or greater.

17. The system of claim 11, wherein the first load sensor is configured to measure at least one of an acceleration, an angular acceleration, a tangential speed, and a rotary speed, and the second load sensor is configured to measure torque.

18. The system of claim 11, wherein the processor is configured to determine a maximum of a high frequency torsional oscillation ("HFTO") amplitude along the drill string and transmit the determined maximum of the HFTO amplitude along the drill string from the drill string to the earth's surface.

19. The system of claim 18, wherein the processor is configured to compare the determined maximum of the HFTO amplitude along the drill string against a load amplitude limit, wherein the load amplitude limit is determined by using at least one of a numerical simulation of the drill string, historical data, and a drill string specification.

20. The system of claim 18, wherein determining the determined maximum of the HFTO amplitude along the drill string comprises the processor using an analytical model, the analytical model using at least one drill string diameter and at least one drill string material property.

* * * * *